US010847133B2

(12) United States Patent
Yamazoe et al.

(10) Patent No.: US 10,847,133 B2
(45) Date of Patent: Nov. 24, 2020

(54) SOUNDPROOF STRUCTURE

(71) Applicant: FUJIFILM Corporation, Tokyo (JP)

(72) Inventors: Shogo Yamazoe, Ashigara-kami-gun (JP); Shinya Hakuta, Ashigara-kami-gun (JP); Akihiko Ohtsu, Ashigara-kami-gun (JP); Yoshihiro Sugawara, Ashigara-kami-gun (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 16/538,162

(22) Filed: Aug. 12, 2019

(65) Prior Publication Data

US 2019/0362700 A1 Nov. 28, 2019

Related U.S. Application Data

(63) Continuation of application No. PCT/JP2018/004793, filed on Feb. 13, 2018.

(30) Foreign Application Priority Data

Feb. 14, 2017 (JP) ..... 2017-024780

(51) Int. Cl.
*G10K 11/172* (2006.01)
*E04B 1/84* (2006.01)
*G10K 11/168* (2006.01)

(52) U.S. Cl.
CPC ..... *G10K 11/172* (2013.01); *E04B 1/8404* (2013.01); *G10K 11/168* (2013.01); *E04B 2001/8461* (2013.01)

(58) Field of Classification Search
CPC .... G10K 11/168; G10K 11/16; G10K 11/172; E04B 1/86; E04B 2001/8461; E04B 1/8404
See application file for complete search history.

(56) References Cited

U.S. PATENT DOCUMENTS

2018/0051462 A1 2/2018 Hakuta et al.

FOREIGN PATENT DOCUMENTS

| | | | |
|---|---|---|---|
| CN | 101499273 | A | 8/2009 |
| CN | 205881450 | U | 1/2017 |
| JP | 2009-003089 | A | 1/2009 |
| JP | 2009-288355 | A | 12/2009 |
| JP | 2010-026258 | A | 2/2010 |

(Continued)

OTHER PUBLICATIONS

Written Opinion for PCT/JP2018/004793, dated Apr. 24, 2018, English translation.

(Continued)

*Primary Examiner* — Forrest M Phillips
(74) *Attorney, Agent, or Firm* — Sughrue Mion, PLLC

(57) ABSTRACT

Provided is a soundproof structure with a small size and high soundproofing performance of a low frequency band. The soundproof structure includes at least one soundproof cell which includes a frame having a hole portion, an elastic layer laminated on a frame of one opening surface of the frame, and a film laminated on the elastic layer so as to cover the hole portion. An effective displacement amount at a position at which an amplitude is maximized in a region bonded to the elastic layer in a case where a film vibration of the film occurs is 0.4% to 10% of an effective displacement amount at a position at which an amplitude of the film is maximized.

14 Claims, 21 Drawing Sheets

(56) References Cited

FOREIGN PATENT DOCUMENTS

| | | | |
|---|---|---|---|
| JP | 2010-097137 | A | 4/2010 |
| JP | 4832245 | B2 | 12/2011 |
| JP | 5543705 | B2 | 7/2014 |
| WO | 2016/208580 | A1 | 12/2016 |

OTHER PUBLICATIONS

International Search Report for PCT/JP2018/004793, dated Apr. 24, 2018.

Office Action dated Feb. 19, 2020 in Chinese Application No. 201880011438.6, English Translation.

International Preliminary Report on Patentability dated Aug. 20, 2019, issued by the International Bureau in corresponding application No. PCT/JP2018/004793, in English.

SOUNDPROOF STRUCTURE

CROSS-REFERENCE TO RELATED APPLICATIONS

This application is a Continuation of PCT International Application No. PCT/JP2018/004793 filed on Feb. 13, 2018, which claims priority under 35 U.S.C. § 119(a) to Japanese Patent Application No. 2017-024780 filed on Feb. 14, 2017. The above application is hereby expressly incorporated by reference, in its entirety, into the present application.

BACKGROUND OF THE INVENTION

1. Field of the Invention

The present invention relates to a soundproof structure.

2. Description of the Related Art

Since the heavier the mass of a general sound insulation material, the better the sound is shielded, the sound insulation material itself becomes large and heavy in order to obtain a favorable sound insulation effect. Meanwhile, it is difficult to shield sound having a low-frequency component in particular. In general, in a case where this region is called the mass law and the frequency has doubled, it has been known that the shielding is increased by 6 dB.

As stated above, since many soundproof structures of the related art have performed sound insulation with the mass of the structure, there is a disadvantage that the soundproof structure becomes large and heavy and it is difficult to perform low-frequency shielding.

In contrast, a soundproof structure in which stiffness of a member is improved by attaching a frame to a sheet or a film has been suggested (see JP4832245B and JP2010-026258A). Such a soundproof structure can achieve light weight and high shielding performance in a specific frequency compared to the soundproof structure of the related art. It is possible to control a sound insulation frequency by changing a shape of the frame, stiffness of the film, or a mass of a sinker.

JP4832245B discloses a sound absorbing body that has a frame body which has a penetrating opening formed therein and a sound absorbing material which covers one opening of the penetrating opening. A storage modulus of elasticity of the sound absorbing material is in a predetermined range (see Abstract, claim 1, Paragraphs [0005] to [0007] and [0034], and the like). The storage modulus of elasticity of the sound absorbing material means a component, which is internally stored, of the energy generated in the sound absorbing material by sound absorption.

In JP4832245B, it is possible to achieve an advanced sound absorption effect in a low-frequency region without an increase in size of the sound absorbing body by preferably using a material having a low specific gravity such as a resin as the frame body from the viewpoints of weight reduction (see Paragraph [0019]), using an acrylic resin in Example (see Paragraph [0030]), using a thermoplastic resin as the sound absorbing material (see Paragraph [0022]), and using a resin or a mixture of the resin with a filler as a formulation material of the sound absorbing material in Example (see Paragraphs [0030] to [0034]).

In JP2010-026258A, a sound absorbing body in which a film vibration type sound absorbing material includes a film body, and a weight member bonded to a center of gravity of the film body through an adhesive layer and a ratio of an area of the weight member to an area of the film body is 1.5% or more is disclosed (see Abstract, claim 1, and Paragraph [0008]).

In JP2010-026258A, a frequency region in which a sound absorption effect is obtained can be shifted to a low frequency side by providing the weight member at the film vibration type sound absorbing material (film body) (see Paragraph [0005]).

SUMMARY OF THE INVENTION

However, in a case where the soundproof structure is arranged in a place having a limitation of a space such as an inside of a narrow duct or a ventilation sleeve or a case where the soundproof structure is arranged while maintaining air permeability, since it is difficult to increase the soundproof structure, there is a problem that sound insulation performance is sufficiently not obtained on the low frequency side in particular.

The present invention has been made in order to overcome the problems of the related art, and an object of the present invention is to provide a soundproof structure with a small size and high soundproofing performance of a low frequency band.

The present inventors have intensively studied in order to achieve the aforementioned object, and have found that the aforementioned object can be solved by a soundproof structure comprising at least one soundproof cell comprising a frame having a hole portion, an elastic layer laminated on a frame of one opening surface of the frame, and a film laminated on the elastic layer so as to cover the hole portion in which an effective displacement amount at a position at which an amplitude is maximized in a region bonded to the elastic layer in a case where a film vibration of the film occurs is 0.4% to 10% of an effective displacement amount at a position at which an amplitude of the film is maximized. The present inventors have completed the present invention.

That is, the present inventors have found that the aforementioned object can be achieved with the following configuration.

(1) There is provided a soundproof structure comprising at least one soundproof cell including a frame having a hole portion, an elastic layer laminated on a frame of an opening surface of the frame, and a film laminated on the elastic layer so as to cover the hole portion. An effective displacement amount at a position at which an amplitude is maximized in a region bonded to the elastic layer in a case where a film vibration of the film occurs is 0.4% to 10% of an effective displacement amount at a position at which an amplitude of the film is maximized.

(2) In the soundproof structure according to (1), the elastic layer is an adhesive layer which bonds the frame and the film.

(3) In the soundproof structure according to (1) or (2), in a case where a thickness of the elastic layer is t and an effective modulus of elasticity of the elastic layer in a thickness direction is $E_{eff}$, a composite parameter $\sigma=t^{1.4}\times(1+1/E_{eff})$ satisfies $3.0\times10^{-2}<\sigma<5\times10^{1}$.

(4) In the soundproof structure according to (3), the elastic layer is a single layer, and the effective modulus of elasticity $E_{eff}$ of the elastic layer in the thickness direction is Young's modulus $E_{young}$ (GPa) of a material of the elastic layer.

(5) In the soundproof structure according to (3), the elastic layer includes a plurality of layers, and in a case where an indentation modulus of elasticity of the elastic layer is $E_{ind}$, the number of layers is N, and an average thickness of the layers is t, the effective modulus of elasticity $E_{eff}$ of the elastic layer in the thickness direction is $E_{eff}=E_{ind}/\{(t/100)^3\times N^5\}$.

(6) In the soundproof structure according to any one of (1) to (5), the soundproof cell is smaller than a wavelength of a first natural vibration frequency of the film vibration of the film.

(7) In the soundproof structure according to (6), the first natural vibration frequency is 100000 Hz or less.

According to the present invention, it is possible to provide a soundproof structure with a small size and high soundproofing performance of a low frequency band.

DESCRIPTION OF THE PREFERRED EMBODIMENTS

Hereinafter, a soundproof structure according to embodiments of the present invention will be described in detail with reference to preferred embodiments shown in the accompanying diagrams.

Although requirements to be described below are described based on representative embodiments of the present invention, the present invention is not limited to the embodiments.

In the present specification, a numeric range expressed by using "~" means a range including values described before and after "~" as a lower limit value and an upper limit value.

[Soundproof Structure]

A soundproof structure according to an embodiment of the present invention comprises at least one soundproof cell comprising a frame having a hole portion, an elastic layer laminated on a frame of an opening surface of the frame, and a film laminated on the elastic layer so as to cover the hole portion. An effective displacement amount at a position at which an amplitude is maximized in a region bonded to the elastic layer in a case where a film vibration of the film occurs is 0.4% to 10% of an effective displacement amount at a position at which an amplitude of the film is maximized.

Figure 1:
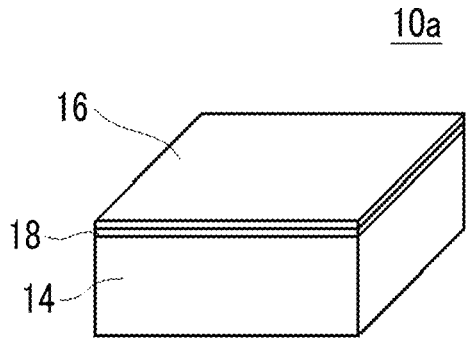
FIG. 1 is a schematic perspective view showing an example of a soundproof structure according to an embodiment of the present invention.
Figure 2:
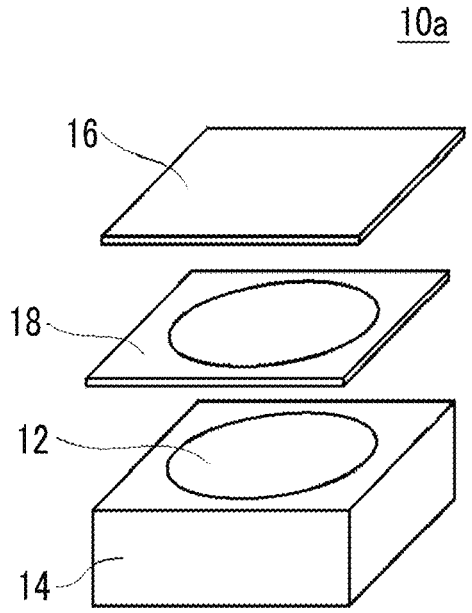
FIG. 2 is an exploded view of the soundproof structure shown in FIG. 1.

FIG. 1 is a schematic perspective view showing an example of a soundproof structure according to an embodiment of the present invention. FIG. 2 is a schematic exploded view of the soundproof structure shown in FIG. 1, and FIG. 3 is a schematic cross-sectional view of the soundproof structure shown in FIG. 1.

Figure 3:
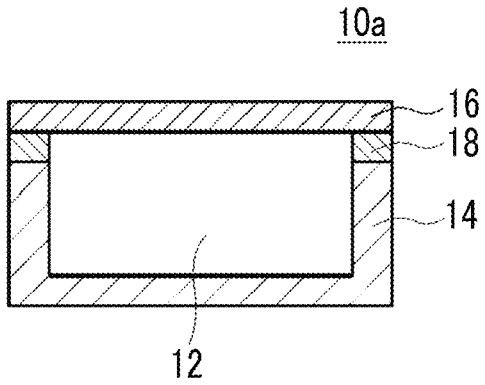
FIG. 3 is a cross-sectional view of the soundproof structure shown in FIG. 1.

A soundproof structure 10*a* shown in FIGS. 1 to 3 includes a frame 14 having a non-penetrating hole portion 12, an elastic layer 18, and a film 16.

In the present invention, the structure including one set of the frame 14, the elastic layer 18, and the film 16 is a soundproof cell, and the soundproof structure 10*a* shown in FIGS. 1 to 3 includes one soundproof cell.

As shown in FIGS. 2 and 3, the elastic layer 18 is laminated on a frame of a surface (opening surface) in which the hole portion of the frame 14 is formed, and a film 16 that covers the hole portion is further laminated on the elastic layer 18.

In the soundproof structure 10*a* having the aforementioned configuration, the film 16 bonded to the frame 14 vibrates so as to correspond to sound waves from outside, and thus, the energy of the sound waves are absorbed or reflected. Accordingly, the sound is insulated.

In this example, the soundproof structure 10*a* according to the embodiment of the present invention includes the elastic layer 18 between the frame 14 and the film 16. In a case where the film vibration occurs, an effective displacement amount of the film 16 at a position at which an amplitude is maximized in a region in which the film 16 and the elastic layer 18 are bonded is 0.4% to 10% of an effective displacement amount at a position at which the amplitude of the film 16 is maximized. In the soundproof structure according to the embodiment of the present invention, the frame 14 and the film 16 are bonded through the elastic layer having elasticity, and thus, it is possible to set a first natural vibration frequency of the film vibration of the film 16 bonded to the frame 14 to be a lower frequency. Accordingly, it is possible to increase the size of the soundproof structure, and it is possible to increase soundproofing performance in a low frequency band.

The aforementioned points will be described in detail below.

The frame 14 has a cube shape, and has the non-penetrating hole portion 12 having a bottom surface on one surface. The frame 14 supports the film 16 arranged so as to cover an opening of the hole portion 12. The elastic layer 18 arranged between the frame 14 and the film 16 is bonded to the frame 14, and thus, a bonded surface of the elastic layer 18 is fixed. Therefore, the frame 14 has higher stiffness than the film 16. Specifically, it is preferable that both the mass and the stiffness of the frame per unit area are high.

It is preferable that the frame 14 has a closed continuous shape capable of bonding the film 16 through the elastic layer 18 so as to restrain the entire periphery of the film 16. However, the present invention is not limited thereto. The frame 14 may be made to have a discontinuous shape by cutting a part thereof as long as the frame fixes the bonded surface of the elastic layer 18 bonded to the frame. That is, since the role of the frame 14 is to fix and support the bonded surface of the elastic layer 18 to control the film vibration, the effect is achieved even in a case where there is a small cut in the frame 14 or there is an unbonded part.

The opening shape of the hole portion 12 of the frame 14 is a planar shape, and is a circle in the illustrated example. In the present invention, the opening shape thereof is not particularly limited. For example, the shape of the hole portion may be a quadrangle such as a square, a rectangle, a diamond, or a parallelogram, a triangle such as an equilateral triangle, an isosceles triangle, or a right triangle, a polygon including a regular polygon such as a regular pentagon or a regular hexagon, an ellipse, and the like, or may be an irregular shape.

One end portion of the hole portion 12 of the frame 14 is not closed, and is opened to the outside. The other end portion thereof is closed. The film 16 is arranged at the opened end portion of the hole portion 12 so as to cover the hole portion 12, and a closed space is formed within the frame 14.

In the example shown in FIGS. 1 to 3, only the end portion on one side of the hole portion 12 of the frame 14 is opened to the outside, and the end portion on the other side is closed. Both the end portions on both sides may not be closed, and may be opened to the outside. In this case, the film 16 that covers the hole portion 12 is bonded to the one opened end portion of the hole portion 12 through the elastic layer 18.

The size of the hole portion 12 of the frame 14 (the size in plan view) can be defined as the diameter of the hole portion 12. In a case where the shape of the hole portion is a circle or a regular polygon such as a square, the size of the hole portion can be defined as a distance between opposite sides passing through the center or as a circle equivalent diameter. In the case of a polygon, an ellipse, or an irregular shape, the size of the hole portion can be defined as a circle equivalent diameter. In the present invention, the circle equivalent diameter is a radius at the time of conversion into circles having the same area.

The size of the hole portion 12 of the frame 14 is not particularly limited, and a soundproofing target to which the soundproof structure according to the embodiment of the present invention is applied for soundproofing is, for example, a copying machine, a blower, air conditioning equipment, a ventilator, a pump, a generator, a duct, industrial equipment including various kinds of manufacturing equipment capable of emitting sound such as a coating machine, a rotary machine, and a conveyor machine, transportation equipment such as an automobile, a train, and aircraft, and general household equipment such as a refrigerator, a washing machine, a dryer, a television, a copying machine, a microwave oven, a game machine, an air conditioner, a fan, a personal computer (PC), a vacuum cleaner, and an air purifier.

The soundproof structure 10 itself can also be used like a partition in order to shield sound from a plurality of noise sources. Also in this case, the size of the hole portion 12 of the frame 14 can be selected from the frequency of the target noise.

It is preferable that the soundproof cell including the frame 14, the film 16, and the elastic layer 18 is smaller than a wavelength of the first natural vibration frequency of the film vibration of the film 16. Thus, it is preferable that the size of the hole portion 12 of the frame 14 is small in order for the soundproof cell to be smaller than the wavelength of the first natural vibration frequency.

The size of the hole portion 12 is not particularly limited. For example, the size of the hole portion is preferably 0.5 mm to 300 mm, more preferably 1 mm to 200 mm, even more preferably 5 mm to 100 mm, and most preferably 10 mm to 80 mm.

The frame thickness and height of the frame 14 (thickness in a punching direction) is also not particularly limited as long as the frame can bond the film 16 and can reliably support the film 16. For example, the frame thickness and height of the frame 14 can be set according to the size of the hole portion 12.

Figure 4:
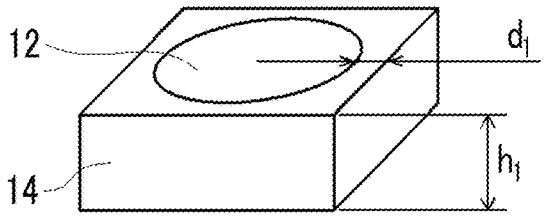
FIG. 4 is a schematic perspective view for describing a shape of a frame.

In this example, the frame thickness of the frame 14 is a thickness $d_1$ of the thinnest portion on the opening surface of the frame 14, as shown in FIG. 4. The height of the frame 14 is a height $h_1$ in the punching direction of the hole portion.

For example, in a case where the size of the hole portion 12 is 0.5 mm to 50 mm, the frame thickness of the frame 14 is preferably 0.5 mm to 20 mm, more preferably 0.7 mm to 10 mm, and most preferably 1 mm to 5 mm.

In a case where the size of the hole portion 12 exceeds 50 mm and is equal to or less than 300 mm, the frame thickness of the frame 14 is preferably 1 mm to 100 mm, more preferably 3 mm to 50 mm, and most preferably 5 mm to 20 mm.

In a case where a ratio of the frame thickness of the frame 14 to the size of the hole portion 12 is too large, an area ratio of the portion of the frame 14 with respect to the entire structure increases. Accordingly, there is a concern that the soundproof structure will become heavy. On the other hand, in a case where the ratio is too small, it is difficult to strongly bond the film 16 with an adhesive or the like in the frame 14 portion.

In addition, the height of the frame 14 is preferably 0.5 mm to 200 mm, more preferably 0.7 mm to 100 mm, and most preferably 1 mm to 50 mm.

Since it is preferable that the soundproof cell is smaller than the wavelength of the first natural vibration frequency of the film vibration of the film 16, it is preferable that the size of the hole portion 12 is equal to or less than the wavelength of the first natural vibration frequency of the film vibration of the film 16 bonded to the frame 14.

Since a sound pressure having a small strength unevenness is applied to a film surface of the film 16 as long as the size of the hole portion 12 of the frame 14 is equal to or less than the wavelength of the first natural vibration frequency of the film vibration of the film 16, it is difficult to induce a vibration mode of the film for which sound control is difficult. That is, the soundproof structure can obtain high sound controllability.

In order for the sound pressure having the small strength unevenness to be applied to the film surface of the film 16, that is, in order for the sound pressure applied to the film surface of the film 16 to be more uniform, in a case where the wavelength of the first natural vibration frequency of the film vibration of the film 16 bonded to the frame 14 is $\lambda$, the size of the hole portion 12 is preferably equal to or less than $\lambda/2$, more preferably equal to or less than $\lambda/4$, even more preferably equal to or less than $\lambda/8$, and most preferably equal to or less than $\lambda/12$.

The material of the frame 14 is not particularly limited as long as the material can support the film 16, has a suitable strength in the case of being applied to the above soundproofing target, and is resistant to the soundproof environment of the soundproofing target, and can be selected according to the soundproofing target and the soundproof environment. For example, metal materials such as aluminum, titanium, magnesium, tungsten, iron, steel, chromium, chromium molybdenum, and nichrome molybdenum, and alloys thereof; resin materials such as acrylic resin, methyl polymethacrylate, polycarbonate, polyamideide, polyarylate, polyether imide, polyacetal, polyether ether ketone, polyphenylene sulfide, polysulfone, polyethylene terephthalate, polybutylene terephthalate, polyimide, and triacetyl cellulose; and carbon fiber reinforced plastics (CFRP); carbon fibers; and glass fiber reinforced plastic (GFRP) can be used as the material of the frame 14.

A plurality of materials of the frame 14 may be used in combination.

A sound absorbing material known in the related art may be arranged within the hole portion 12 of the frame 14.

The sound absorbing material is arranged, and thus, it is possible to further improve sound insulation characteristics due to a sound absorption effect using the sound absorbing material. It is possible to widen the band of the frequency range to be absorbed.

The sound absorbing material is not particularly limited, but various known sound absorbing materials such as urethane foam, glass wool, or a non-woven fabric can be used.

As stated above, the combination of the known sound absorbing materials is used within the soundproof structure according to the embodiment of the present invention, and thus, it is possible to obtain both an effect using the soundproof structure according to the embodiment of the present invention and an effect using the known sound absorbing material.

The film 16 is bonded through the elastic layer 18 laminated on the frame 14 so as to cover the hole portion 12 formed in the frame 14. The film 16 absorbs or reflects the energy of sound waves to insulate sound by performing film vibration corresponding to the sound waves from the outside.

In the following description, a case where the film 16 is bonded to the frame 14 through the elastic layer 18 is simply referred to as a case where the film 16 is bonded to the frame 14.

Incidentally, the film 16 needs to vibrate by being bonded to the frame 14 (elastic layer 18). Thus, it is necessary that the film is bonded to the frame so as to be reliably restrained by the frame 14 and accordingly becomes an anti-node of film vibration, thereby absorbing or reflecting the energy of sound waves to insulate sound. Therefore, it is preferable that the film 16 is made of a flexible elastic material.

The shape and size of the film 16 in plan view are not limited as long as the film has the shape and size capable of covering the hole portion 12 of the frame 14. In the example shown in FIGS. 1 to 3, the shape and size of the film 16 are the same shape and size as an outer shape of the frame 14.

Here, the thickness of the film 16 is not particularly limited as long as the film can vibrate by absorbing the energy of sound waves to insulate sound. However, it is preferable to make the film thick in order to obtain a natural vibration mode on a high frequency side and make the film thin in order to obtain the natural vibration mode on a low frequency side. In the present invention, for example, the thickness of the film 16 can be set according to the size of the hole portion 12, that is, the size of the film 16.

For example, in a case where the size of the hole portion 12 is 0.5 mm to 50 mm, the thickness of the film 16 is preferably 0.001 mm (1 μm) to 5 mm, more preferably 0.005 mm (5 μm) to 2 mm, and most preferably 0.01 mm (10 μm) to 1 mm.

In a case where the size of the hole portion 12 exceeds 50 mm and is equal to or less than 300 mm, the thickness of the film 16 is preferably 0.01 mm (10 μm) to 20 mm, more preferably 0.02 mm (20 μm) to 10 mm, and most preferably 0.05 mm (50 μm) to 5 mm.

It is preferable that the thickness of the film 16 is expressed by an average thickness, for example, in a case where there are different thicknesses in one film 16.

In this example, the film vibration of the film 16 bonded to the frame 14 through the elastic layer 18 has the first natural vibration frequency which is a frequency of a lowest-order natural vibration mode. The first natural vibration frequency is a frequency of the lowest-order natural vibration mode capable of being induced in the structure of the soundproof structure 10*a*.

The first natural vibration frequency is a resonance frequency in which transmission loss is minimized for a sound field substantially perpendicularly incident on the film 16, and which has the lowest-order absorption peak. That is, in the present invention, sound is transmitted in the first natural vibration frequency of the film vibration of the film 16, and the absorption peak having the lowest-order frequency appears.

In the present invention, the first natural vibration frequency is determined by the soundproof cell including the frame 14, the film 16, and the elastic layer 18. In the present invention, the first natural vibration frequency determined in this manner is referred to as the first natural vibration frequency of the film.

The first natural vibration frequency of the film vibration of the film 16 bonded to the frame 14 through the elastic layer 18 (for example, the first resonance frequency in which the boundary between the frequency region following the stiffness law and the frequency region following the mass law is the lowest order) is preferably 10 Hz to 100000 Hz which is equivalent to a range of sound waves that can be sensed by humans, more preferably 20 Hz to 20000 Hz which is an audible range of sound waves that can be heard by humans, even more preferably 40 Hz to 16000 Hz, and most preferably 100 Hz to 12000 Hz.

In this example, in the soundproof structure (soundproof cell), the resonance frequency of the film vibration in the structure including the frame 14, the film 16, and the elastic layer 18, for example, the first natural vibration frequency can be determined by a geometric form of the frame 14, for example, the shape and dimension (size) of the frame 14 (hole portion 12), the stiffness of the film 16, for example, the thickness and the flexibility of the film 16 and the volume of the space behind the film, and the thickness and modulus of elasticity of the elastic layer 18.

In the present invention, the elastic layer 18 is provided, and thus, it is possible to set the first natural vibration frequency of the film vibration to be lower frequency. The aforementioned point will be described in detail below.

As parameters that feature the natural vibration mode of the film vibration in a case where the elastic layer including only the frame and the film is not provided, a ratio of a thickness (t) of the film 16 to the square of a size (R) of the hole portion 12 in the case of the film 16 using the same kind of material, for example, a ratio $[R^2/t]$ of a size of one side in the case of a square can be used. In a case where this ratio $[R^2/t]$ is equal, the natural vibration mode is the same frequency, that is, the same resonance frequency. That is, the ratio $[R^2/t]$ has a constant value, and thus, the scale law is established. Accordingly, it is possible to select an appropriate size.

Young's modulus of the film 16 is not particularly limited as long as the film 16 has elasticity capable of vibrating by absorbing or reflecting the energy of sound waves to insulate sound. It is preferable that the Young's modulus of the film 16 is set to be high in order to obtain the natural vibration mode on the high frequency side and is set to be low in order to obtain the natural vibration mode on the low frequency side. For example, the Young's modulus of the film 16 can be set according to the size of the frame 14 (hole portion 12), that is, the size of the film in the present invention.

For example, the Young's modulus of the film 16 is preferably 1000 Pa to 3000 GPa, more preferably 10000 Pa to 2000 GPa, and most preferably 1 MPa to 1000 GPa.

For example, the density of the film 16 is not particularly limited as long as the film can vibrate by absorbing or reflecting the energy of the sound waves to insulate the sound. The density of the film member is preferably 5 $kg/m^3$ to 30000 $kg/m^3$, more preferably 10 $kg/m^3$ to 20000 $kg/m^3$, and most preferably 100 $kg/m^3$ to 10000 $kg/m^3$.

In a case where a film-shaped material or a foil-shaped material is used as the material of the film 16, the material of the film is not particularly limited as long as the material has a strength in the case of being applied to the above soundproofing target and is resistant to the soundproof environment of the soundproofing target so that the film 16 can vibrate by absorbing or reflecting the energy of sound waves to insulate sound, and can be selected according to the soundproofing target, the soundproof environment, and the like. A material or a structure capable of forming a thin structure such as a resin material capable of being formed in a film shape such as polyethylene terephthalate (PET), polyimide, polymethylmethacrylate, polycarbonate, acrylic (PMMA), polyamideide, polyarylate, polyetherimide, polyacetal, polyetheretherketone, polyphenylene sulfide, polysulfone, polyethylene terephthalate, polybutylene terephthalate, polyimide, triacetyl cellulose, polyvinylidene chloride, low-density polyethylene, high-density polyethylene, aromatic polyamide, silicone resin, ethylene ethyl acrylate, vinyl acetate copolymer, polyethylene, chlorinated polyethylene, polyvinyl chloride, polymethyl pentene, and polybutene; a metal material capable of being formed in a foil shape such as aluminum, chromium, titanium, stainless steel, nickel, tin, niobium, tantalum, molybdenum, zirconium, gold, silver, platinum, palladium, iron, copper, and permalloy; a material capable of being formed as a fibrous film such as paper and cellulose; nonwoven fabrics; films including nano-sized fibers; porous materials such as thinly processed urethane and Thinsulate; and carbon materials processed into a thin film structure can be used as the material of the film 16.

The film 16 is bonded to the frame 14 through the elastic layer 18 so as to cover the opening of the hole portion 12 of the frame 14. In a case where the hole portion 12 is a through-hole, the film 16 may be bonded to the frame 14 so as to cover any one opening or both openings of the hole portion 12 of the frame 14.

The elastic layer 18 is a sheet-shaped object in which a through-hole opened in the same shape as the opening of the hole portion 12 formed in the frame 14 is formed. The elastic layer 18 is laminated on the frame on the surface (opening surface) in which the hole portion 12 of the frame 14 is formed such that the position of the through-hole is aligned with the opening of the hole portion 12 of the frame 14. The film 16 is laminated on the elastic layer 18. That is, the elastic layer 18 is arranged between the frame 14 and the film 16.

The elastic layer 18 is formed at a predetermined thickness by using a material having a predetermined modulus of elasticity such that the effective displacement amount of the film 16 at the position at which the amplitude is maximized in a region of the film which is bonded to the elastic layer 18 in a case where the film vibration occurs is 0.4% to 10% of the effective displacement amount at the position at which the amplitude of the film 16 is maximized.

In this example, as stated above, the soundproof structure according to the embodiment of the present invention has the elastic layer 18 between the frame 14 and the film 16 and is configured such that the effective displacement amount of the film 16 at the position at which the amplitude is maximized in the region of the film which is bonded to the elastic layer 18 in a case where the film vibration occurs is 0.4% to 10% of the effective displacement amount at the position at which the amplitude of the film 16 is maximized.

In the soundproof structure according to the embodiment of the present invention, the frame 14 and the film 16 are bonded through the elastic layer having elasticity, and thus, the elastic layer 18 expands and contracts in response to the film vibration in a case where the film 16 vibrates, and the film 16 in a bonded region in which the film is bonded to the elastic layer 18 is displaced. The film 16 is displaced in the bonded region of the film 16 and the elastic layer 18, and thus, the vibration mode of the film vibration of the film 16 bonded to the frame 14 is changed. Accordingly, it is possible to achieve low frequency. Accordingly, it is possible to increase the soundproofing performance in the low frequency band without increasing the size of the soundproof structure.

The effective displacement amount (hereinafter, also referred to as a vibration-portion effective displacement amount) at the position at which the amplitude of the film is maximized in a case where the film vibration occurs is a root mean square of a displacement amount at a position at which an amplitude is the highest in a region of the film which is not bonded to the elastic layer 18.

In the following description, the region of the film 16 which is not bonded to the elastic layer 18 is also referred to as a vibration portion. That is, the vibration-part effective displacement amount is the root mean square of the displacement amount at a position at which the amplitude is the highest at the vibration portion.

Specifically, the position of the vibration portion in which the amplitude is the highest depends on the shape of the hole portion 12, but is a central position in a case where the shape of the hole portion is a circle or a square. In a case where the shape of the hole portion 12 is a shape other than the circle or the square, the position in which the amplitude is the highest during the natural vibration depending on the shape may be obtained through calculation using a finite element method in advance.

The displacement of the vibration is measured by a laser displacement meter at a position at which the amplitude is the highest. It is assumed that a sampling rate in this case is sufficiently smaller than a frequency to be measured. A root mean square of data corresponding to one cycle of a single frequency of the measured displacement is calculated, and the vibration-portion effective displacement amount is obtained. Since the vibration of the film is regarded as a sine wave, the vibration-portion effective displacement amount can be obtained by amplitude/$\sqrt{2}$.

The effective displacement amount (hereinafter, also referred to as a bonded-portion effective displacement amount) of the film 16 at the position at which the amplitude is maximized in the region of the film which is bonded to the elastic layer 18 is a root mean square of a displacement amount at a position at which an amplitude is the highest in a region of the film which is bonded to the elastic layer 18.

Furthermore, in the following description, the region of the film 16 which is bonded to the elastic layer 18 is also referred to as a bonded portion.

Specifically, the position of the bonded portion in which the amplitude is the highest depends on the shapes of the frame 14 and the hole portion 12. Thus, the position in which the amplitude is the highest during the natural vibration depending on the shape may be obtained through the calculation using the finite element method in advance.

Figure 5:
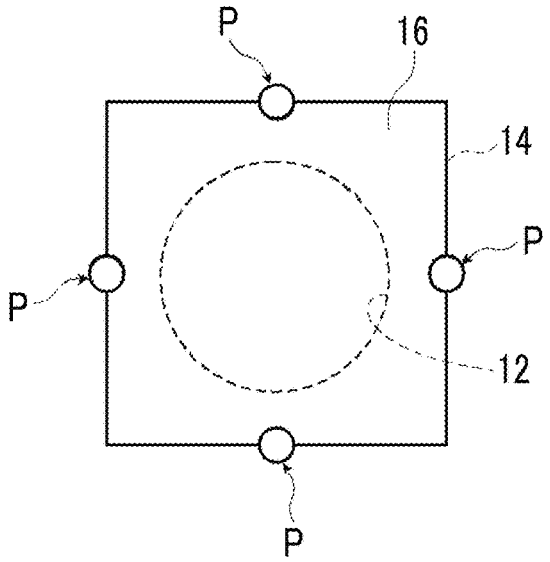
FIG. 5 is a schematic top view for describing a position at which an amplitude is maximized at a bonded portion.
Figure 6:
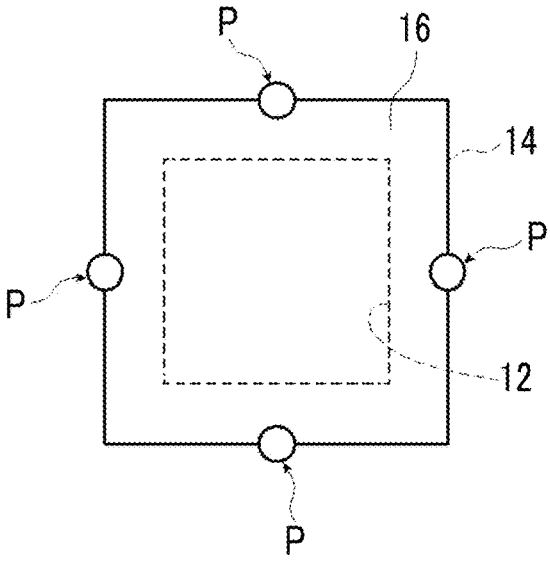
FIG. 6 is a schematic top view for describing the position at which the amplitude is maximized at the bonded portion.

For example, as shown in FIG. 5, in a case where the outer shape of the opening surface of the frame 14 is the square and the hole portion 12 is the circle, the amplitude is the highest in the central position of each side of the frame 14 as represented by P in the drawing. As shown in FIG. 6, even in a case where the outer shape of the opening surface of the frame 14 and the shape of the hole portion 12 is the square, the amplitude is the highest in the central position of each side of the frame 14 as represented by P in the drawing.

The displacement of the vibration is measured by a laser displacement meter at a position at which the amplitude is the highest. It is assumed that a sampling rate in this case is sufficiently smaller than a frequency to be measured. A root mean square of data corresponding to one cycle of a single frequency of the measured displacement is calculated, and the bonded-portion effective displacement amount is obtained.

A method of measuring a displacement waveform in a case where the vibration-portion effective displacement amount and the bonded-portion effective displacement amount are obtained is as follows.

The soundproof structure is placed within a transparent acoustic tube such as acrylic resin used for measuring an absorption rate, and the displacement amounts are measured at the position at which the amplitude is the highest in the vibration portion of the film and at the position at which the amplitude is maximized in the bonded portion by using the laser displacement meter (for example, a laser interface displacement meter system LV-2100A manufactured by Ono Sokki Co., Ltd., and a laser spot is within a range of 15 μm to 100 μm, and a measurement sampling is 10000 Hz or more) from the outside of the acoustic tube while generating sound having a sound pressure of 93 dB in a frequency range of 100 Hz to 2500 Hz within the acoustic tube from a speaker.

Alternatively, the displacement amounts at the position at which the amplitude is the highest in the vibration portion of the film and at the position at which the amplitude is the highest in the bonded portion may be obtained through simulation using the finite element method.

In this example, as shown in FIG. 2, the shape of the elastic layer 18 in plan view may be the same shape as the shape of the frame 14 in plan view. However, the shape of the elastic layer is not limited thereto. The shape of the elastic layer may be a shape in which the elastic layer is arranged in a part of the frame on the opening surface of the frame 14, or may be arranged so as to cover the opening surface. It is preferable that the elastic layer 18 has a closed continuous shape capable of bonding the film 16 so as to restrain the entire periphery of the film 16. However, the present invention is not limited thereto. Since the elastic layer 18 has a discontinuous shape by cutting a part thereof and exhibits resonance characteristics due to an external sound pressure as long as air resistance in a gap is sufficiently large even though the elastic layer is connected to the outside, a space within the hole portion 12 of the frame 14 is substantially a closed space. That is, even though the small cut is formed in the elastic layer 18, there may be an unbonded part.

Figure 7:
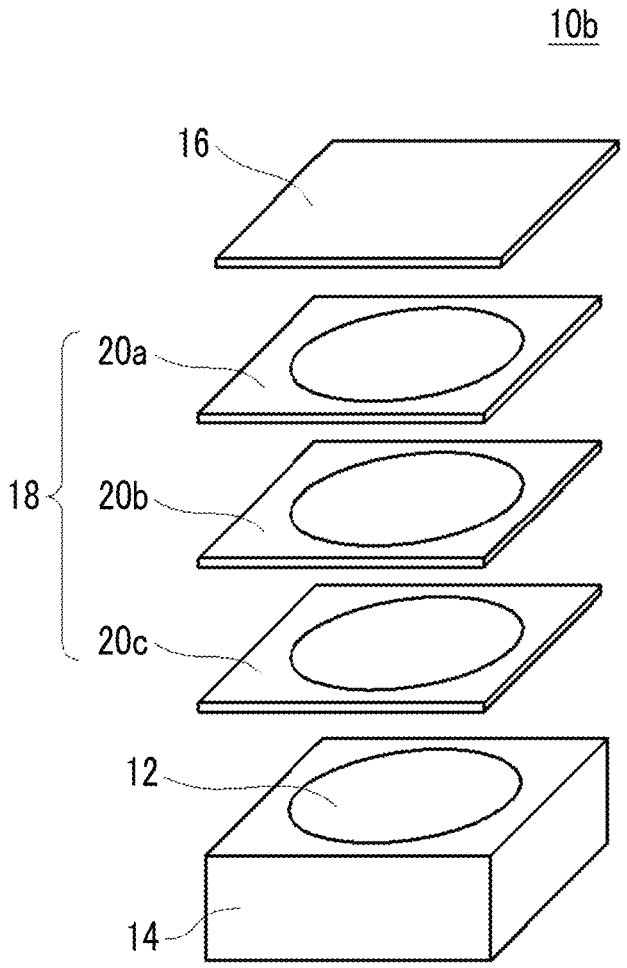
FIG. 7 is a schematic exploded view showing another example of the soundproof structure according to the embodiment of the present invention.
Figure 8:
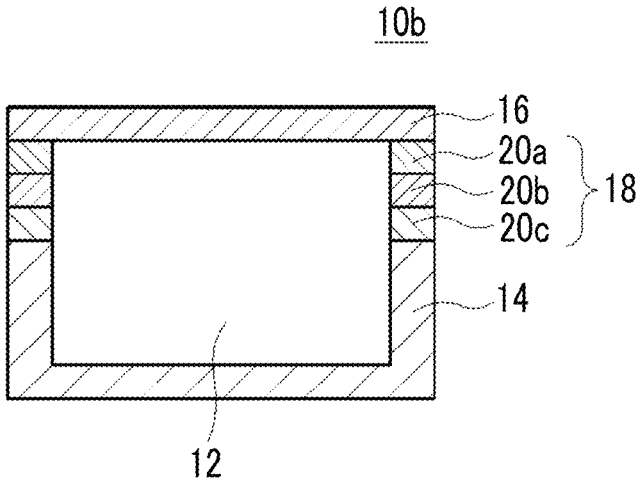
FIG. 8 is a cross-sectional view of the soundproof structure shown in FIG. 7.

In the soundproof structure 10*a* shown in FIGS. 1 to 3, the elastic layer 18 has a single-layer configuration, but the present invention is not limited thereto. As in a soundproof structure 10*b* shown in FIGS. 7 and 8, the elastic layer 18 may be a multi-layer configuration in which a plurality of layers is laminated. In the example shown in FIGS. 7 and 8, the elastic layer 18 has a three-layer configuration including a first layer 20*a*, a second layer 20*b*, and a third layer 20*c*, but the present invention is not limited thereto. The elastic layer 18 may have a two-layer configuration, or may have four or more layers.

In a case where the elastic layer 18 includes the plurality of layers, the layers may be made of the same material or may be made of different materials.

The method of bonding the elastic layer 18 to the frame 14 and the film 16 is not limited, but the elastic layer and the frame and the film can be bonded by using an adhesive. The elastic layer 18 may also function to connect the frame 14 and the film 16 to each other. That is, the elastic layer 18 may be an adhesive layer.

The material of the elastic layer 18 (the first layer 20*a*, the second layer 20*b*, and the third layer 20*c* constituting the elastic layer 18) can be adhesives, for example, rubber-based solvent type adhesives, acrylic-based solvent type adhesives, silicone-based solvent type adhesives, vinyl-based solvent type adhesives, acrylic-based emulsion type adhesives, and hot-melt type adhesives. A main material thereof is specifically natural rubber, styrene butadiene, polyisobutylene, isoprene, acrylic ester, silicone rubber, silicone resin, styrene-isoprene-styrene block copolymer (SIS), polyethylene-vinyl-acetate block copolymer (EVA), styrene-butadiene-styrene block copolymer (SBS), or styrene-ethylene-butylene-styrene block copolymer (SEBS).

The material of the elastic layer 18 can be paper, cloth, non-woven fabric, plastic film, rubber sheet, or metal foil.

For example, the elastic layer 18 may be formed such that the adhesive is laminated on both surfaces of a backing made of a paper, cloth, non-woven fabric, plastic film, rubber sheet, or metal foil, like a double-sided tape. The elastic layer may be formed by laminating a plurality of double-sided tapes. The elastic layer may be formed by laminating a plurality of adhesives. Alternatively, the elastic layer may be formed by laminating the adhesive and the double-sided tape.

In a case where the film 16 is bonded to the elastic layer 18 (frame 14), the film 16 may be bonded by giving tension to the film, but it is preferable that the film is bonded without giving the tension.

At least a part of an end portion of the film 16 may be bonded. That is, a part may be a free end, or there may be a non-joining part of a simple support. The end portion (peripheral portion) of the film 16 is preferably in contact with the elastic layer 18. 50% or more of the end portion of the film 16 is preferably bonded to the elastic layer 18, and 90% or more of the end portion of the film is more preferably bonded to the elastic layer 18.

In this example, in the elastic layer 18, in a case where the thickness of the elastic layer 18 is t and an effective modulus of elasticity of the elastic layer 18 in a thickness direction is $E_{eff}$, it is preferable that a composite parameter σ obtained by $\sigma=t^{1.4}\times(1+1/E_{eff})$ satisfies $3.0\times10^{-2}<\sigma<5.0\times10^{1}$.

As can be seen from [Example 7] to be described below, in order to increase the displacement amount of the bonded portion, even though the film thickness of the elastic layer 18 is increased or the modulus of elasticity is decreased, the vibration mode is not excited in a case where the displacement amount reaches a certain value. Instead, a higher-order vibration mode having a high frequency is excited. Thus, there is a limitation to reducing the frequency of the film vibration. The composite parameter σ that uniformly handles two causes of the modulus of elasticity and the thickness of the elastic layer 18 falls within the aforementioned range, and thus, it is possible to set the increase in low frequency and limitation.

In a case where a self-supporting film of the elastic layer is extracted from the soundproof structure, the effective modulus of elasticity $E_{eff}$ is determined by tensile testing to be described below. In a case where the self-supporting film of the elastic layer is not extracted, the effective modulus of elasticity $E_{eff}$ of the elastic layer may be obtained by using a nanoindentation method (for example, an evaluation for the modulus of elasticity using indentation using MFP-3D Infinity AFM manufactured by The Asylum) and a picosecond ultrasound method (a method of evaluating the modulus of elasticity from a sound speed by propagating ultrasonic waves having a pulse width of a picosecond by using a femtosecond laser and reference document (physical Review Letters, Vol. 69, page 1668 (1992), O. B. Wright et al.)) by exposing one surface of the elastic layer (in a state in which the other surface is bonded to a frame body or the film).

The effective modulus of elasticity (hereinafter, simply referred to as an effective modulus of elasticity) of the elastic layer 18 in the thickness direction in a case where the elastic layer 18 is the single layer may use the Young's modulus $E_{young}$ (GPa) of the material of the elastic layer 18.

In the measurement of the Young's modulus $E_{young}$ in a case where the elastic layer 18 is the single layer, the young's modulus is measured by performing the tensile testing at a thickness of a measurement sample of 300 μm or more with a load of 10 N by using a tensile tester (for example, Tensilon universal material testing machine manufactured by A&D Company, Limited). For example, in the case of "double-sided tape transparent type backing-less HJ-9150W-50 50 μm" manufactured by Nitto Denko Corporation, the Young's modulus is measured by laminating six layers and pulling these layers in a direction perpendicular to the lamination direction.

Meanwhile, in a case where the elastic layer 18 includes the plurality of layers, assuming that the number of layers is N and an average thickness of the layers is t, the effective modulus of elasticity $E_{eff}$ of the elastic layer 18 is defined by $E_{eff}=E_{ind}/\{(t/100)^3\times N^5\}$.

$E_{ind}$ is an indentation modulus of elasticity obtained by using an indentation device (for example, Fischerscope HM2000 manufactured by Fischer Instruments K.K).

As a measurement condition, the layers are indented with a predetermined load by applying the maximum load of 200 mN for 20 seconds by using a Berkovich indenter, the load applied to the layers is maintained for 5 seconds, and then the load applied to the layers is removed at a predetermined loading speed for 20 seconds. As a result, a load and unload curve was obtained. Three kinds of film thicknesses are measured for the sample. In order to obtain an indentation modulus of elasticity of the film thickness with which it is estimated that the influence of a board can be eliminated, the exponential fitting of the film thickness dependency of the indentation modulus of elasticity on the three kinds of film thicknesses was performed, and the indentation modulus of elasticity obtained through extrapolation calculation up to 2000 μm was used.

The average thickness t of the plurality of layers constituting the elastic layer is measured by cutting out a cross section of the soundproof structure through cutting and performing cross-sectional observation by using a general optical microscope (for example, upright microscope BX53M manufactured by Olympus Corporation).

In this example, in a case where the composite parameter σ is very large, the higher-order vibration mode occurs, and thus, the frequency of the film vibration is increased. Meanwhile, in a case where the composite parameter σ is very small, a low frequency effect is lost or a minute low frequency effect is obtained.

In this regard, the composite parameter σ is preferably $3\times10^{-2}<\sigma<5\times10^{1}$, more preferably $3\times10^{-1}<\sigma<5\times10^{1}$, and even more preferably $2.5<\sigma<5\times10^{1}$.

Although it has been described in this example shown in FIGS. 1 to 3 that the soundproof structure includes one soundproof cell, the present invention is not limited thereto. As in a soundproof structure 100 shown in FIGS. 9 and 10, a plurality of soundproof cells may be included.

Figure 9:
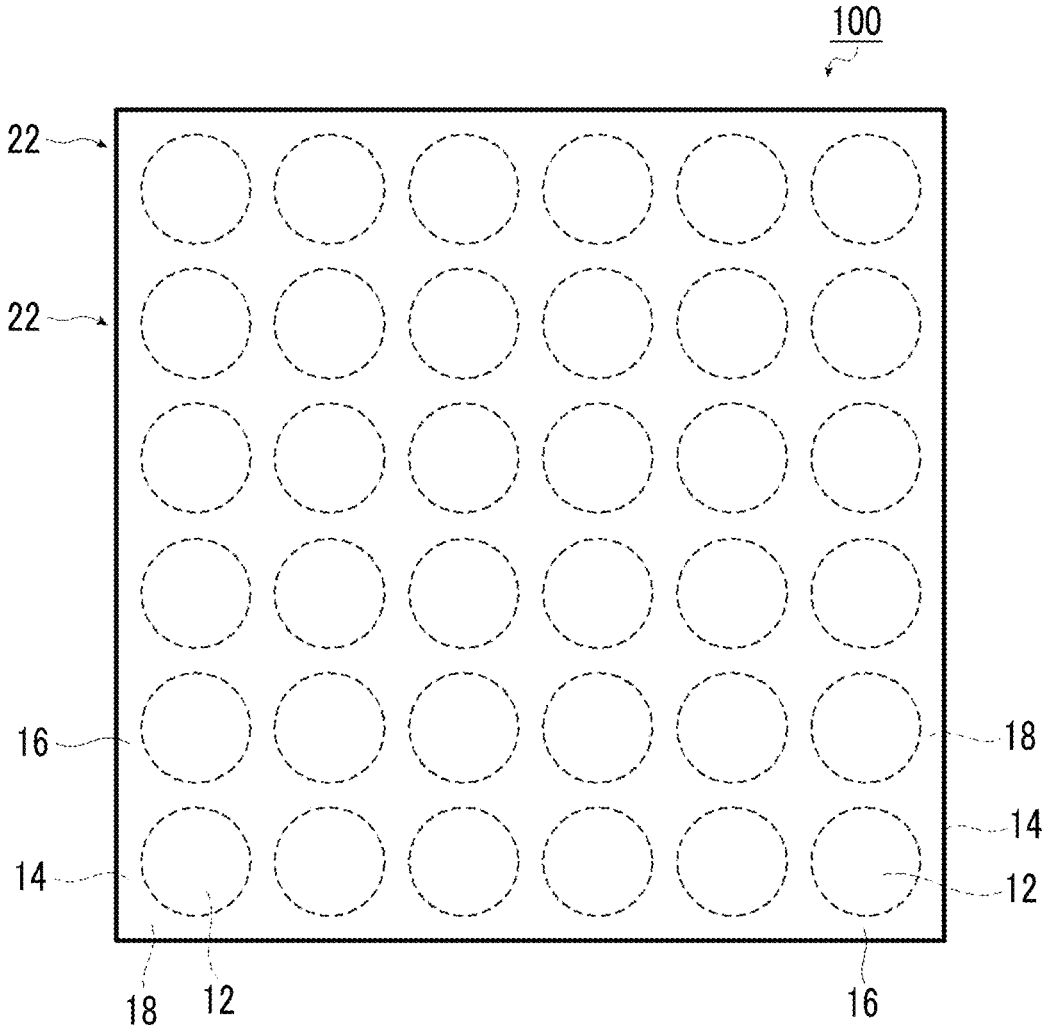
FIG. 9 is a schematic plan view showing another example of the soundproof structure according to the embodiment of the present invention.
Figure 10:
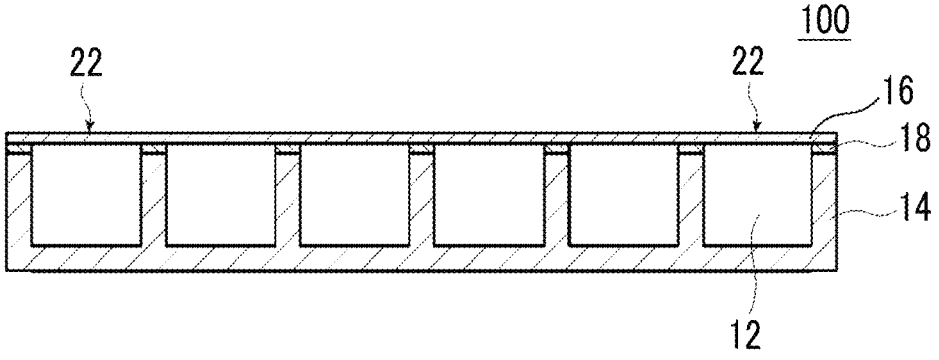
FIG. 10 is a cross-sectional view of the soundproof structure shown in FIG. 9.

FIG. 9 is a schematic plan view of another example of the soundproof structure according to the embodiment of the present invention, and FIG. 10 is a cross-sectional view of the soundproof structure shown in FIG. 9.

The soundproof structure 100 shown in FIGS. 9 and 10 has a configuration in which 6×6 soundproof cells 22 are arranged as the soundproof cell 22 of the soundproof structure shown in FIG. 1.

In the example shown in FIGS. 9 and 10, the soundproof structure includes a total of 36 (6×6) soundproof cells, and the present invention is not limited thereto. Any number of soundproof cells may be used as long as the soundproof structure includes the plurality of soundproof cells. The number of soundproof cells may be set according to the soundproofing target. Alternatively, since the size of the hole portion 12 is set according to the soundproofing target, the number of soundproof cells may be set according to the size of the hole portion 12.

In the example shown in FIGS. 9 and 10, the frames 14 of the soundproof cells 22 are two-dimensionally connected, and are provided as one frame body. The frames 14 of the soundproof cells 22 may be arranged as separate members, and are connected.

Similarly, in the example shown in FIGS. 9 and 10, the films 16 of the soundproof cells 22 are two-dimensionally connected, and are provided as one film body. The films 16 of the soundproof cells 22 may be separate members.

Similarly, in the example shown in FIGS. 9 and 10, the elastic layers 18 of the soundproof cells 22 are two-dimensionally connected, and are provided as one elastic member. The elastic layers 18 of the soundproof cells 22 may be separate members.

Although it has been described in the soundproof structure shown in FIGS. 9 and 10 that the plurality of soundproof cells is the same as each other, different soundproof cells may be provided.

For example, soundproof cells in which the sizes of the hole portions 12 of the frames 14 are different (including the shapes are different) may be included. Soundproof cells in which depths of the hole portions 12 and frame thicknesses of the frames 14 are different may be included.

Similarly, soundproof cells in which the materials and thicknesses of the films 16 are different may be included.

Similarly, soundproof cells in which the materials, thicknesses, and layer configurations of the elastic layers 18 are different may be included.

Although it has been described in the example shown in FIGS. 1 to 3 that the hole portion 12 has a straight tube shape in which a cross section perpendicular to a depth direction is not changed, the present invention is not limited thereto. For example, as in a soundproof structure 10*c* shown in FIGS. 11 and 12, the cross-sectional shape of the hole portion 12 may be changed in the depth direction.

Figure 11:
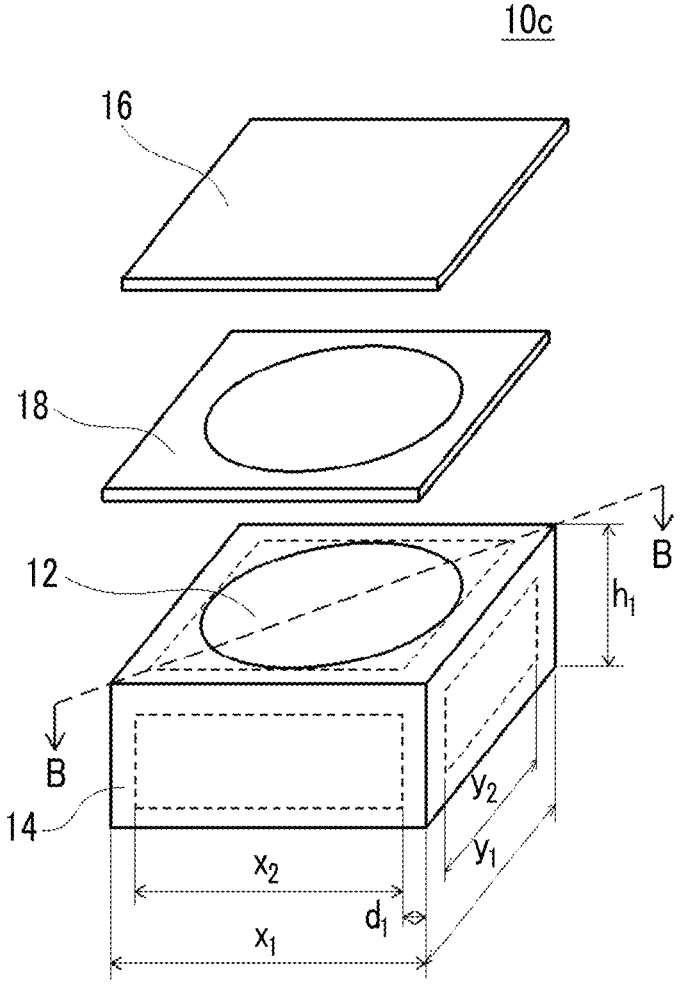
FIG. 11 is a schematic exploded view showing another example of the soundproof structure according to the embodiment of the present invention.
Figure 12:
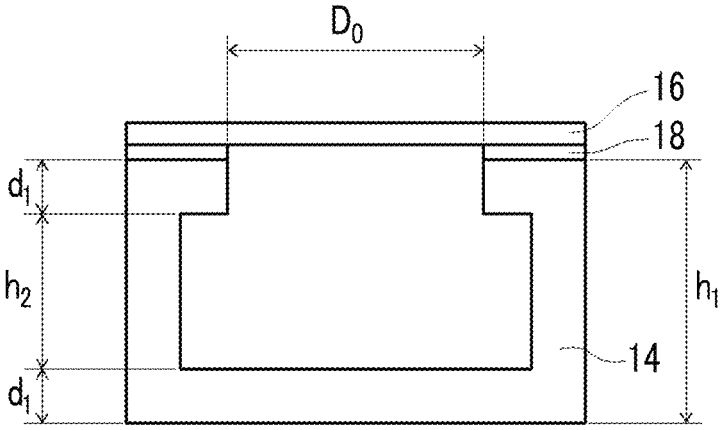
FIG. 12 is a cross-sectional view taken along a line B-B of FIG. 11.

An external shape of the frame 14 of the soundproof structure 10*c* shown in FIGS. 11 and 12 is a cube shape. The frame has a cube-shaped cavity therein, and a circular hole portion which penetrates through the cavity in the center of one surface as the maximum surface.

The film 16 may be formed by boring one or more through-holes.

A sinker may be provided at the film 16.

It is possible to adjust the first natural vibration frequency of the film vibration by providing the through-hole or the sinker in the film 16. Particularly, it is possible to decrease the frequency of the first natural vibration frequency of the film vibration by providing the sinker on the film 16.

Hereinafter, the physical properties or characteristics of a structural member that can be combined with a soundproof member having the soundproof structure according to the embodiment of the present invention will be described.

[Flame Retardancy]

In the case of using a soundproof member having the soundproof structure according to the embodiment of the present invention as a soundproof material in a building or a device, flame retardancy is required.

Therefore, the film is preferably flame retardancy. As the film, for example, Lumirror (registered trademark) nonhalogen flame-retardant type ZV series (manufactured by Toray Industries) that is a flame-retardant PET film, Teijin Tetoron (registered trademark) UF (manufactured by Teijin), and/or Dialamy (registered trademark) (manufactured by Mitsubishi Plastics) that is a flame-retardant polyester film may be used.

The frame is also preferably a flame-retardant material. A metal such as aluminum, an inorganic material such as ceramic, a glass material, flame-retardant polycarbonate (for example, PCMUPY 610 (manufactured by Takiron)), and/or flame-retardant plastics such as flame-retardant acrylic (for example, Acrylite (registered trademark) FR1 (manufactured by Mitsubishi Rayon)) can be mentioned.

It is preferable that a flame retardant adhesive is used even in a case where the adhesive is used as the elastic layer. For example, VHB™ acrylic foam tape Y-4545 series manufactured by 3M, a double-sided tape No. 5011N manufactured by Nitto Denko Corporation, a flame retardant double-sided adhesive tape TL-827SB-30NF manufactured by Lintec Corporation, and a backing-less type double-sided tape #8080NR manufactured by DIC Corporation are used.

[Heat Resistance]

There is a concern that the soundproofing characteristics may be changed due to the expansion and contraction of the structural member of the soundproof structure according to the embodiment of the present invention due to an environmental temperature change. Therefore, the material forming the structural member is preferably a heat resistant material, particularly a material having low heat shrinkage.

As the film, for example, Teijin Tetoron (registered trademark) film SLA (manufactured by Teijin DuPont), PEN film Teonex (registered trademark) (manufactured by Teijin DuPont), and/or Lumirror (registered trademark) off-anneal low shrinkage type (manufactured by Toray) are preferably used. In general, it is preferable to use a metal film, such as aluminum having a smaller thermal expansion factor than a plastic material.

As the frame, it is preferable to use heat resistant plastics, such as polyimide resin (TECASINT 4111 (manufactured by Enzinger Japan)) and/or glass fiber reinforced resin (TECAPEEK GF 30 (manufactured by Enzinger Japan)) and/or to use a metal such as aluminum, an inorganic material such as ceramic, or a glass material.

It is preferable that a heat-resistant adhesive is also used as the adhesive used as the elastic layer.

[Weather Resistance and Light Resistance]

In a case where the soundproof member having the soundproof structure according to the embodiment of the present invention is arranged outdoors or in a place where light is incident, the weather resistance of the structural member becomes a problem.

Therefore, as the film, it is preferable to use a weather-resistant film, such as a special polyolefin film (ARTPLY (registered trademark) (manufactured by Mitsubishi Plastics)), an acrylic resin film (ACRYPRENE (manufactured by Mitsubishi Rayon)), and/or Scotch Calfilm (trademark) (manufactured by 3M).

As the frame, it is preferable to use plastics having high weather resistance such as polyvinyl chloride, polymethyl methacryl (acryl), metal such as aluminum, inorganic materials such as ceramics, and/or glass materials.

It is preferable that a high weatherproof adhesive is also used as the adhesive used as the elastic layer.

Regarding moisture resistance as well, it is preferable to appropriately select a film, a frame, and an elastic layer having high moisture resistance. Regarding water absorption and chemical resistance, it is preferable to appropriately select an appropriate film, frame, and elastic layer.

[Dust]

During long-term use, dust may adhere to the film surface to affect the soundproofing characteristics of the soundproof structure according to the embodiment of the present invention. Therefore, it is preferable to prevent the adhesion of dust or to remove adhering dust.

As a method of preventing dust, it is preferable to use a film formed of a material to which dust is hard to adhere. For example, by using a conductive film (Flecria (registered trademark) (manufactured by TDK) and/or NCF (Nagaoka Sangyou)) so that the film member is not charged, it is possible to prevent adhesion of dust due to charging. It is also possible to suppress the adhesion of dust by using a fluororesin film (Dynoch Film (trademark) (manufactured by 3M)), and/or a hydrophilic film (Miraclain (manufactured by Lifegard Co.), RIVEX (manufactured by Riken Technology Inc.) and/or SH2CLHF (manufactured by 3M)). By using a photocatalytic film (Raceline (manufactured by Kimoto)), contamination of the film member can also be prevented. A similar effect can also be obtained by applying a spray having the conductivity, hydrophilic property and/or photocatalytic property and/or a spray containing a fluorine compound to the film member.

In addition to using the above special films, it is also possible to prevent contamination by providing a cover on the film. As the cover, it is possible to use a thin film material (Saran Wrap (registered trademark) or the like), a mesh having a mesh size not allowing dust to pass therethrough, a nonwoven fabric, a urethane, an airgel, a porous film, and the like.

As a method of removing adhering dust, it is possible to remove dust by emitting sound having the resonance frequency of a film and strongly vibrating the film. The same effect can be obtained even in a case where a blower or wiping is used.

[Wind Pressure]

The film is exposed to strong wind, and thus, the film is pressed. As a result, there is a possibility that the resonance frequency will be changed. Thus, nonwoven fabric, urethane, and/or a film is covered on the film, and thus, it is possible to suppress the influence of the wind.

[Arrangement]

Since the soundproof member including the soundproof structure according to the embodiment of the present invention can be easily attached to or detached from the wall, it is preferable that an attachment mechanism constituted by a magnetic body, Velcro (registered trademark), a button, or a suction cup is attached to the soundproof member. For example, the attachment mechanism may be attached to a side surface of the frame, the attachment mechanism may be attached to the wall, and the soundproof member may be attached to the wall. The attachment mechanism attached to the soundproof member may be detached from the wall, and the soundproof member may be separated from the wall.

In a case where the soundproof structures of which frequency bands to be insulated are different are combined as the soundproof cells, it is preferable that the attachment mechanism such as a magnetic body, Velcro (registered trademark), a button, and an absorption cup is attached to each soundproof cell such that the soundproof cells are easily combined.

The soundproof cells may be attached by forming a recess portion and a protrusion portion at each soundproof cell and engaging the protrusion portion of one soundproof cell with the recess portion of the other soundproof cell. In a case where the plurality of soundproof cells is combined, both the protrusion portion and the recess portion may be formed at one soundproof cell.

The soundproof cell may be attached by combining the aforementioned attachment mechanism with the protrusion portion and the recess portion.

[Frame Mechanical Strength]

As the size of the soundproof member including the soundproof structure according to the embodiment of the present invention becomes large, the frame tends to vibrate, and a function as the fixed end for the film vibration is degraded. Thus, it is preferable that the frame stiffness increases by increasing the thickness of the frame. However, in a case where the thickness of the frame increases, the mass of the soundproof member increases, the advantage of the present soundproof member of which the weight is light is degraded.

Thus, since the increase in mass is reduced while maintaining high stiffness, it is preferable that a hole or a groove is formed in the frame. For example, a truss structure or a Rahmen structure is used as the frame, and thus, it is possible to achieve both high stiffness and light weight.

The soundproof structure according to the embodiment of the present invention is basically configured as described above.

The soundproof structure according to the embodiment of the present invention can be used as the following soundproof members.

For example, as soundproof members having the soundproof structure according to the embodiment of the present invention, it is possible to mention: a soundproof member for building materials (soundproof member used as building materials); a soundproof member for air conditioning equipment (soundproof member installed in ventilation openings, air conditioning ducts, and the like to prevent external noise); a soundproof member for external opening part (soundproof member installed in the window of a room to prevent noise from indoor or outdoor); a soundproof member for ceiling (soundproof member installed on the ceiling of a room to control the sound in the room); a soundproof member for floor (soundproof member installed on the floor to control the sound in the room); a soundproof member for internal opening part (soundproof member installed in a portion of the inside door or sliding door to prevent noise from each room); a soundproof member for toilet (soundproof member installed in a toilet or a door (indoor and outdoor) portion to prevent noise from the toilet); a soundproof member for balcony (soundproof member installed on the balcony to prevent noise from the balcony or the adjacent balcony); an indoor sound adjusting member (soundproof member for controlling the sound of the room); a simple soundproof chamber member (soundproof member that can be easily assembled and can be easily moved); a soundproof chamber member for pet (soundproof member that surrounds a pet's room to prevent noise); amusement facilities (soundproof member installed in a game centers, a sports center, a concert hall, and a movie theater); a soundproof member for temporary enclosure for construction site (soundproof member for covering construction site to prevent leakage of a lot of noise around the construction site); and a soundproof member for tunnel (soundproof member installed in a tunnel to prevent noise leaking to the inside and outside the tunnel).

EXAMPLES

The soundproof structure according to the embodiment of the present invention will be described in detail by way of examples. The materials, the amount to be used, the proportion, the processing content, and the processing procedure shown in the following examples can be appropriately changed without departing from the spirit of the present invention. Accordingly, the scope of the present invention should not be interpreted as being limited by the following examples.

Comparative Example 1

Initially, a soundproof structure configured such that the maximum displacement amount of the film at the position at which the film is bonded to the elastic layer in a case where the film vibration occurs is out of 0.4% to 10% of the maximum displacement amount of the film was manufactured as Comparative Example 1.

Specifically, a copper foil film of which a size is 50 mm×50 mm and a thickness is 80 μm was used as the film. As in the frame 14 shown in FIGS. 11 and 12, a frame of which an external shape is a cube shape, a cube-shaped cavity is formed therein, and a circular hole portion penetrating the cavity is formed in the center of one surface as the maximum surface was used as the frame. An external dimension $x_1 \times y_1 \times h_1$ of the frame 14 was 50 mm×50 mm×26 mm, a dimension $x_2 \times y_2 \times h_2$ of a cavity portion was 44 mm×44 mm×20 mm, a diameter $D_0$ of the hole portion was 44 mm, and a frame thickness $d_1$ was 3 mm. That is, the depth of the hole portion is 23 mm. The material of the frame was acryl.

A double-sided tape 1 ("Genbapower" (backing: paper, adhesive: acrylic-based, and model number: 7881078) manufactured by ASKUL Corporation) was cut according to the shape of the frame portion of the opening surface of the frame. The cut double-sided tape adheres to the frame portion of the opening surface of the frame. The film adheres onto the double-sided tape, and thus, the soundproof structure was manufactured.

Three measurement samples obtained by laminating one, three, and six double-sided tapes 1 were respectively manufactured, and the indentation modulus of elasticity was measured by using the indentation device (for example, Fischerscope HM2000 manufactured by Fischer Instruments K.K).

As a measurement condition, the layers are indented with a predetermined load by applying the maximum load of 200 mN for 20 seconds by using a Berkovich indenter, the load applied to the layers is maintained for 5 seconds, and then the load applied to the layers is removed at a predetermined loading speed for 20 seconds. As a result, a load and unload curve was obtained. The exponential fitting of the film thickness dependency of the indentation modulus of elasticity on three kinds of obtained film thicknesses was performed, and the indentation modulus of elasticity $E_{ind}$ was obtained through the extrapolation calculation up to 2000 μm.

The thickness of the double-sided tape was measured as 100 μm by using the optical microscope.

The effective modulus of elasticity $E_{eff}$ and the composite parameter σ of the double-sided tape 1 were obtained from the obtained indentation modulus of elasticity $E_{ind}$ and thickness t. The effective modulus of elasticity $E_{eff}$ was 20 MPa. The composite parameter σ was $1.3 \times 10^4$.

Figure 13:
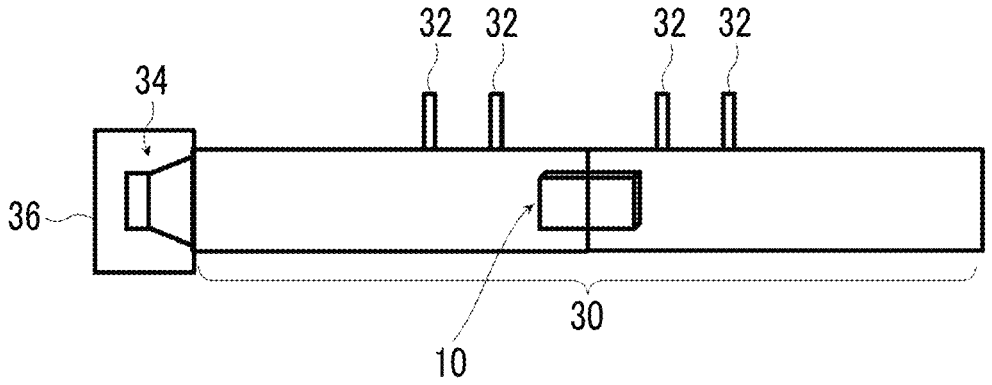
FIG. 13 is a schematic diagram for describing a method of measuring acoustic characteristics.

The frequency characteristics of the absorption rate of the soundproof structure of Comparative Example 1 were measured by using a four-terminal method using an acoustic tube (see FIG. 13).

An acoustic tube which is made of acryl and has a circular cross section having a diameter of 8 cm was used as the acoustic tube 30.

This method is based on "ASTM E2611-09: Standard Test Method for Measurement of Normal Incidence Sound Transmission of Acoustical Materials Based on the Transfer Matrix Method". The measurement using a transfer function method is performed by using four microphones 32 which generate sound toward the inside of the acoustic tube 30 from one opening surface of the acoustic tube 30 in a speaker 34 and guide the sound into the acoustic tube 30 from the peripheral surface of the acoustic tube. It is possible to measure the sound transmission loss in a wide spectral band using this method.

The soundproof structure was arranged in the central portion of the acoustic tube. An orientation of the soundproof structure was an orientation in which the film surface of the film member matches the cross section of the acoustic tube. The frequency to be measured was 0 Hz to 2000 Hz.

Comparative Example 2

Next, frequency characteristics of the absorption rate were obtained by performing the simulation modeling of the soundproof structure of Comparative Example 1, as Comparative Example 2.

Specifically, a model of the soundproof structure having the same configuration as that of Comparative Example 1 was created by using an acoustic module of COMSOL version 5.1 which is analysis software of the finite element method. The obtained effective modulus of elasticity $E_{eff}$ (20 MPa) was used as the modulus of elasticity of the double-sided tape 1. The density of the double-sided tape 1 was 0.3 g/cm$^3$.

The modulus of elasticity of the film made of a copper foil film was 119 GPa, and the density was 8.94 g/cm$^3$.

The simulation of the evaluation of the acoustic characteristics was performed by modeling a normal incidence absorption rate measurement method generally used in the evaluation of the acoustic characteristics. A model in which the soundproof structure was arranged in a center of a cylindrical acoustic tube having a diameter of 8 cm and plane sound waves are propagated from one surface of the acoustic tube was obtained. A ratio between an incident volume and a value obtained by subtracting a transmission volume detected on a surface opposite to an incident side and a reflection volume detected on a surface of the incident side from the incident volume was calculated as the absorption rate.

The vibration-portion effective displacement amount of the film was 5500 nm, the bonded-portion effective displacement amount was 1.45 nm, and a ratio between the effective displacement amounts was 0.026%.

Comparative Example 3

As Comparative Example 3, a soundproof structure was manufactured similarly to Comparative Example 1 except that a PET film (Lumirror manufactured by Toray Industries, Inc.) having a thickness of 250 μm was used as the film, and frequency characteristics of the absorption rate were measured.

Comparative Example 4

As Comparative Example 4, the frequency characteristics of the absorption rate were obtained by performing the simulation modeling of the soundproof structure similarly to Comparative Example 2 except that a PET film having a thickness of 250 μm was used as the film. That is, Comparative Example 4 is obtained by performing the simulation modeling of Comparative Example 3.

The modulus of elasticity of the film made of the PET film was 4.6 GPa, and the density was 1.4 g/cm$^3$.

The vibration-portion effective displacement amount of the film was 3620 nm, the bonded-portion effective displacement amount was 0.41 nm, and the ratio between the effective displacement amounts was 0.011%.

Figure 14:
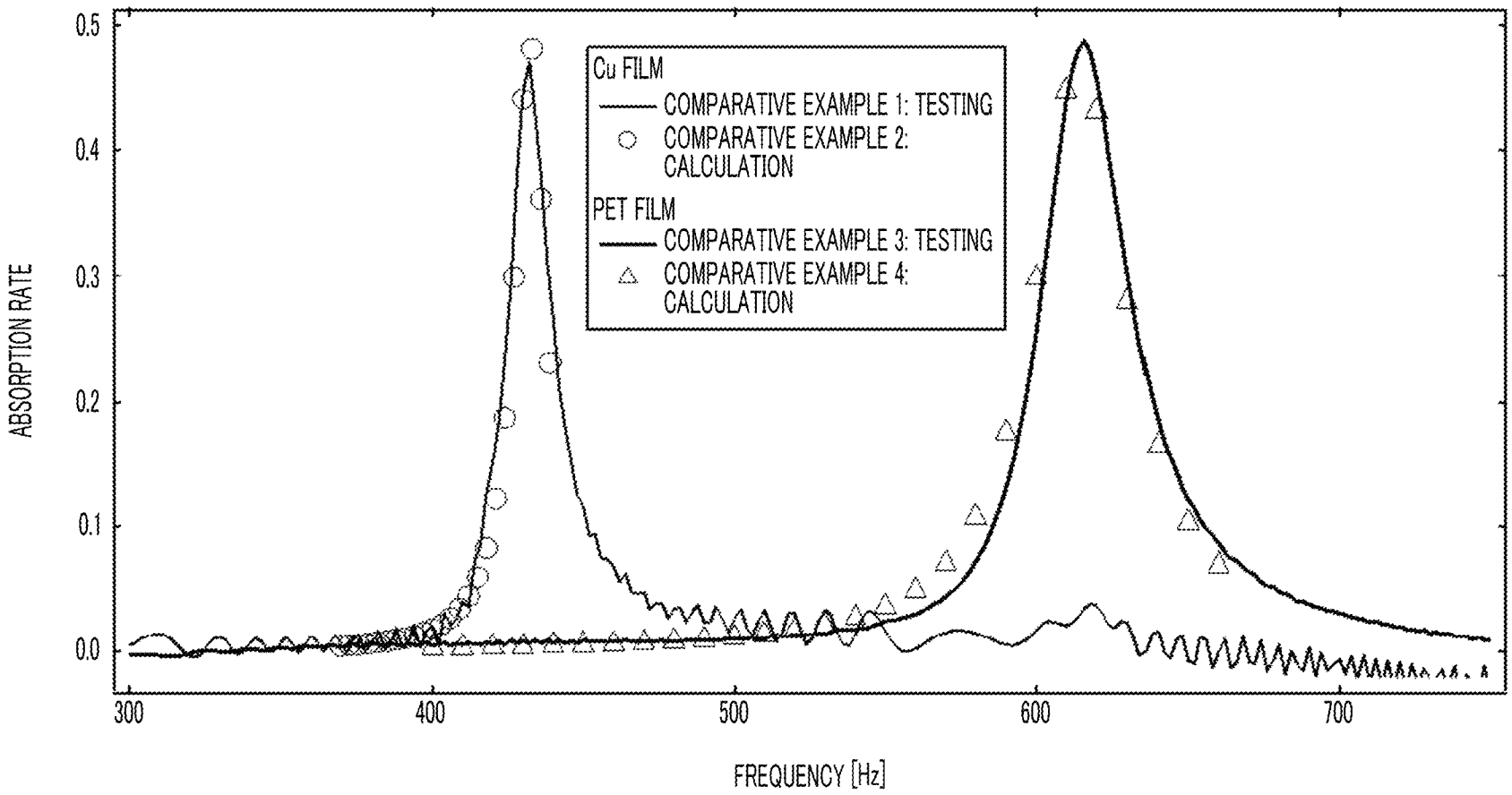
FIG. 14 is a graph showing a relationship between a frequency and an absorption rate.

The results of Comparative Examples 1 to 4 are represented in FIG. 14.

As shown in FIG. 14, it can be seen that the testing and the calculation matched each other and an appropriate calculation model was established.

[Simulation 1]

As Simulation 1, a simulation model was created similarly to Comparative Example 1 except that the thickness of the elastic layer between the frame and the film was 120 μm, and the frequency characteristics of the absorption rate were obtained while variously changing the modulus of elasticity of the elastic layer.

Figure 15:
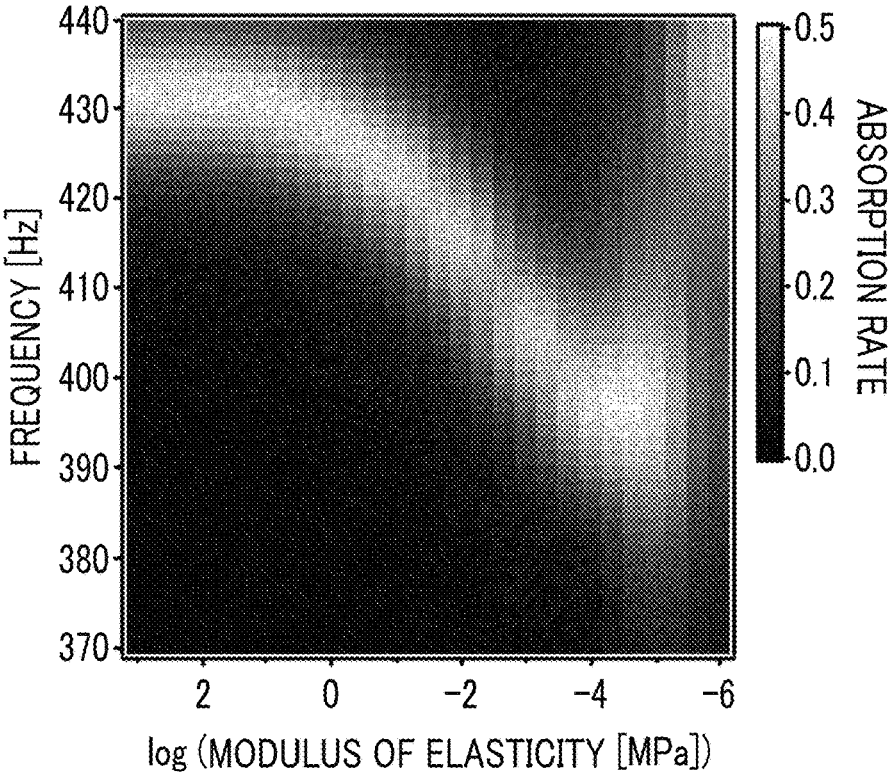
FIG. 15 is a graph showing a relationship between modulus of elasticity, a frequency, and an absorption rate.

FIG. 15 shows the relationship between the modulus of elasticity, the frequency, and the absorption rate obtained through the simulation.

Figure 16:
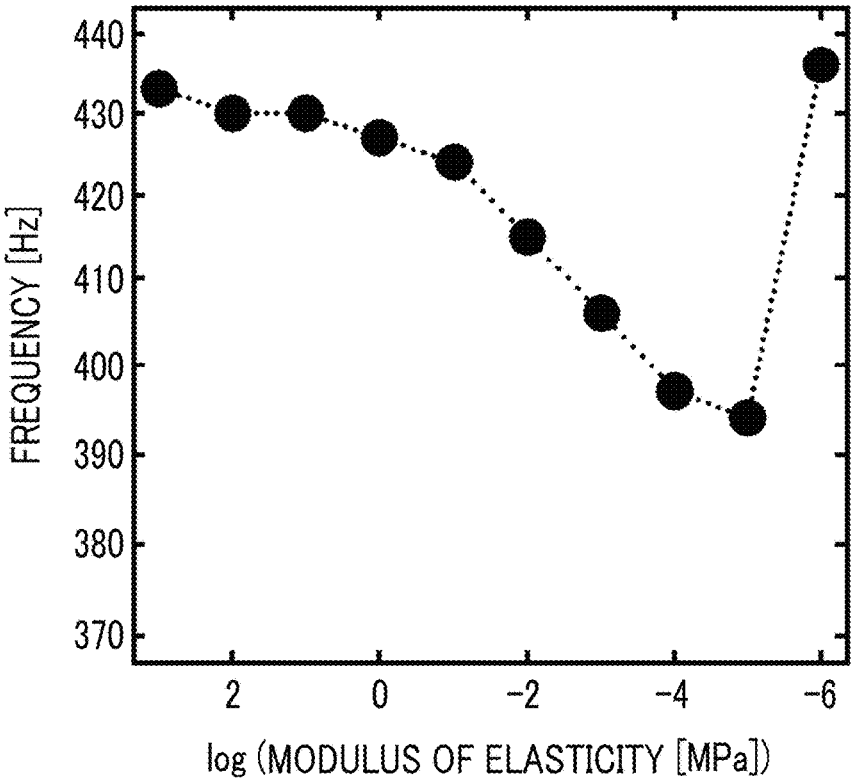
FIG. 16 is a graph showing a relationship between modulus of elasticity and a frequency.

FIG. 16 is a graph a frequency in which the absorption rate becomes a peak (hereinafter, also referred to as absorption peak frequency) is extracted for each modulus of elasticity from FIG. 15 and the modulus of elasticity and the extracted frequency in which the absorption rate becomes the peak are plotted.

As shown in FIGS. 15 and 16, it can be seen that as the elastic layer becomes smaller, the peak frequency become low. However, in a case where the modulus of elasticity is very small, it can be seen that the absorption peak frequency is sharply increased.

Figure 17:
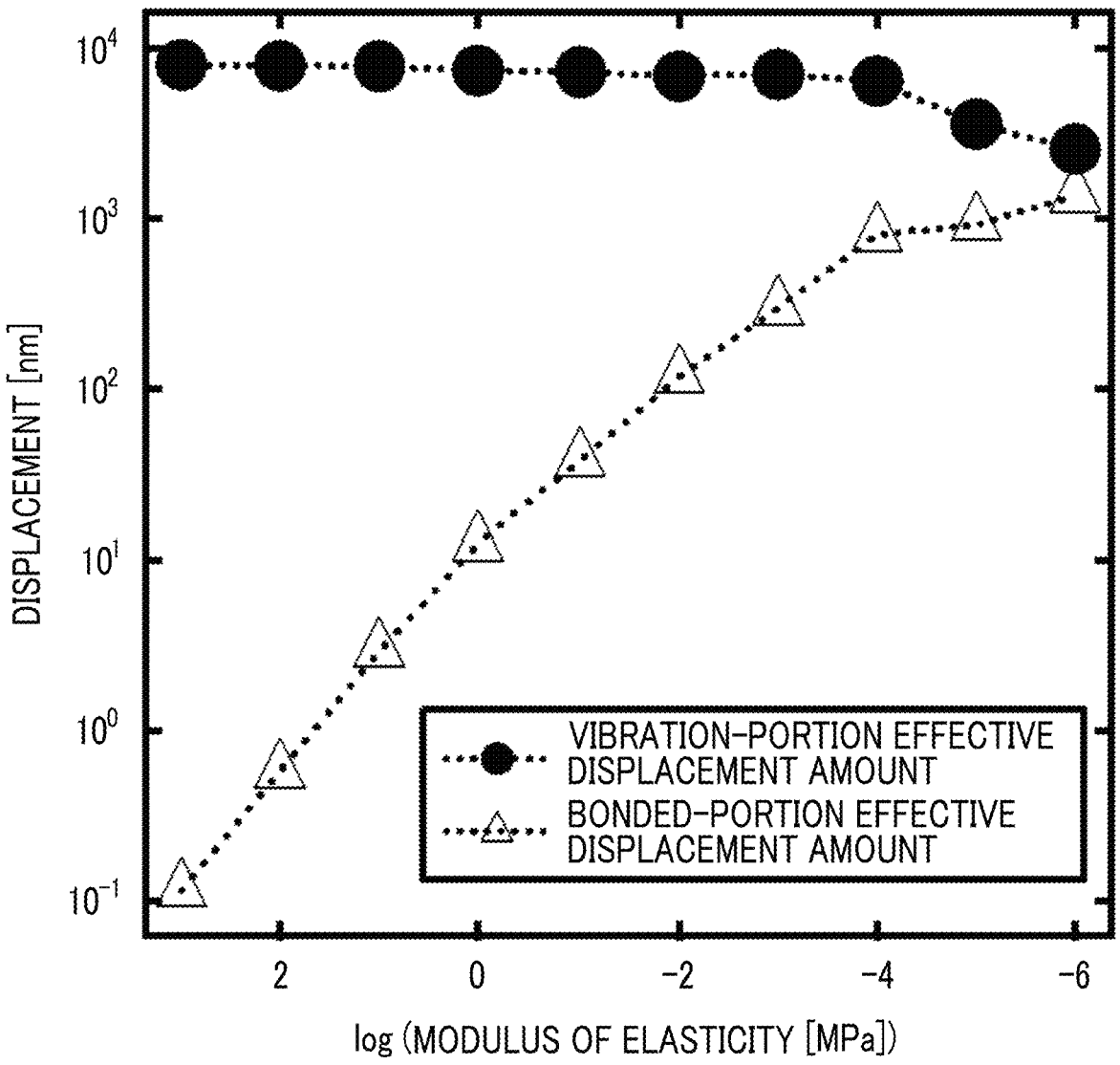
FIG. 17 is a graph showing a relationship between modulus of elasticity and displacement.

The relationship between the modulus of elasticity and the vibration-portion effective displacement amount and the bonded-portion effective displacement amount of the film in the absorption peak frequency obtained during the simulation of the frequency characteristics is shown in FIG. 17.

As shown in FIG. 17, it can be seen that the vibration-portion effective displacement amount is not greatly changed by the modulus of elasticity of the elastic layer, but as the modulus of elasticity of the elastic layer becomes smaller, the bonded-portion effective displacement amount becomes large.

[Simulations 2, 3, and 4]

Next, as Simulation 2, a simulation model was created similarly to Simulation 1 except that the modulus of elasticity of the elastic layer was $1\times10^{-4}$ GPa, and the frequency characteristics of the absorption rate were obtained while variously changing the thickness of the elastic layer.

Similarly, as Simulation 3, a simulation model was created similarly to Simulation 1 except that the modulus of elasticity of the elastic layer was $1\times10^{-6}$ GPa, and the frequency characteristics of the absorption rate were obtained while variously changing the thickness of the elastic layer.

Similarly, as Simulation 4, a simulation model was created similarly to Simulation 1 except that the modulus of elasticity of the elastic layer was 10 GPa, and the frequency characteristics of the absorption rate were obtained while variously changing the thickness of the elastic layer.

Figure 18:
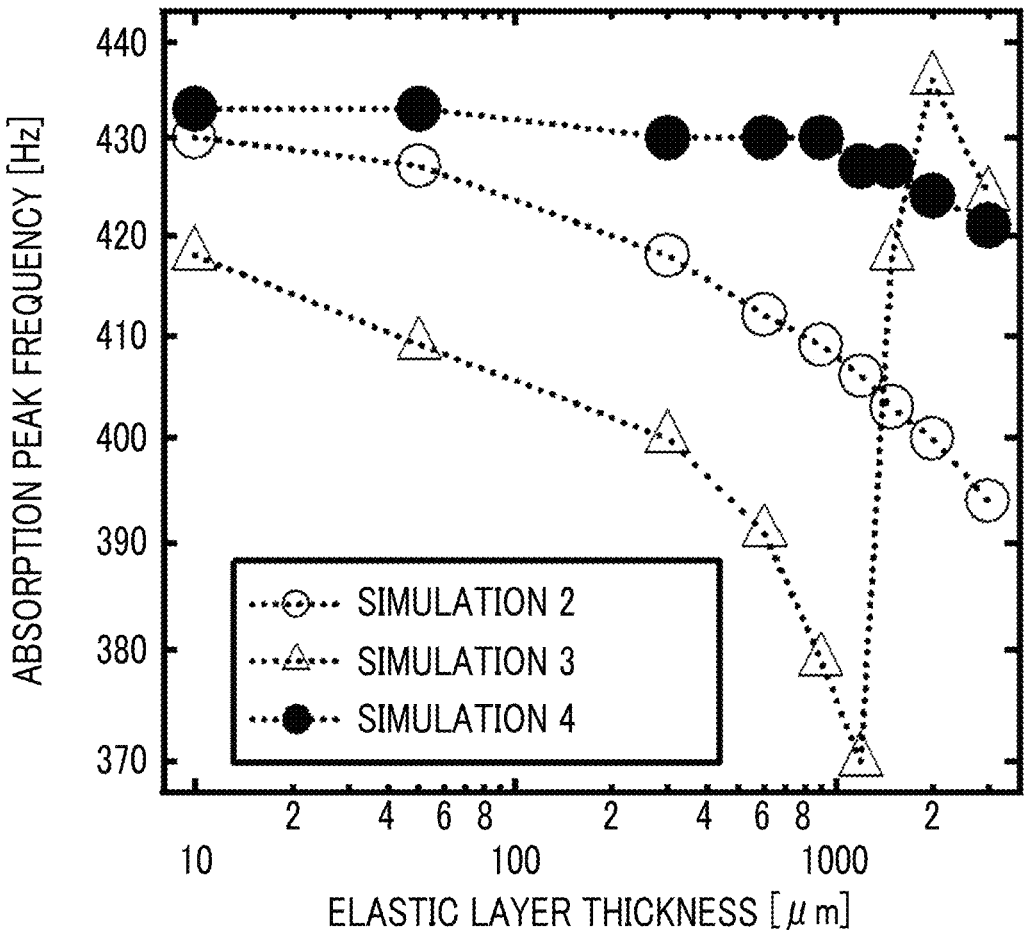
FIG. 18 is a graph showing a relationship between a thickness of an elastic layer and an absorption peak frequency.
Figure 19:
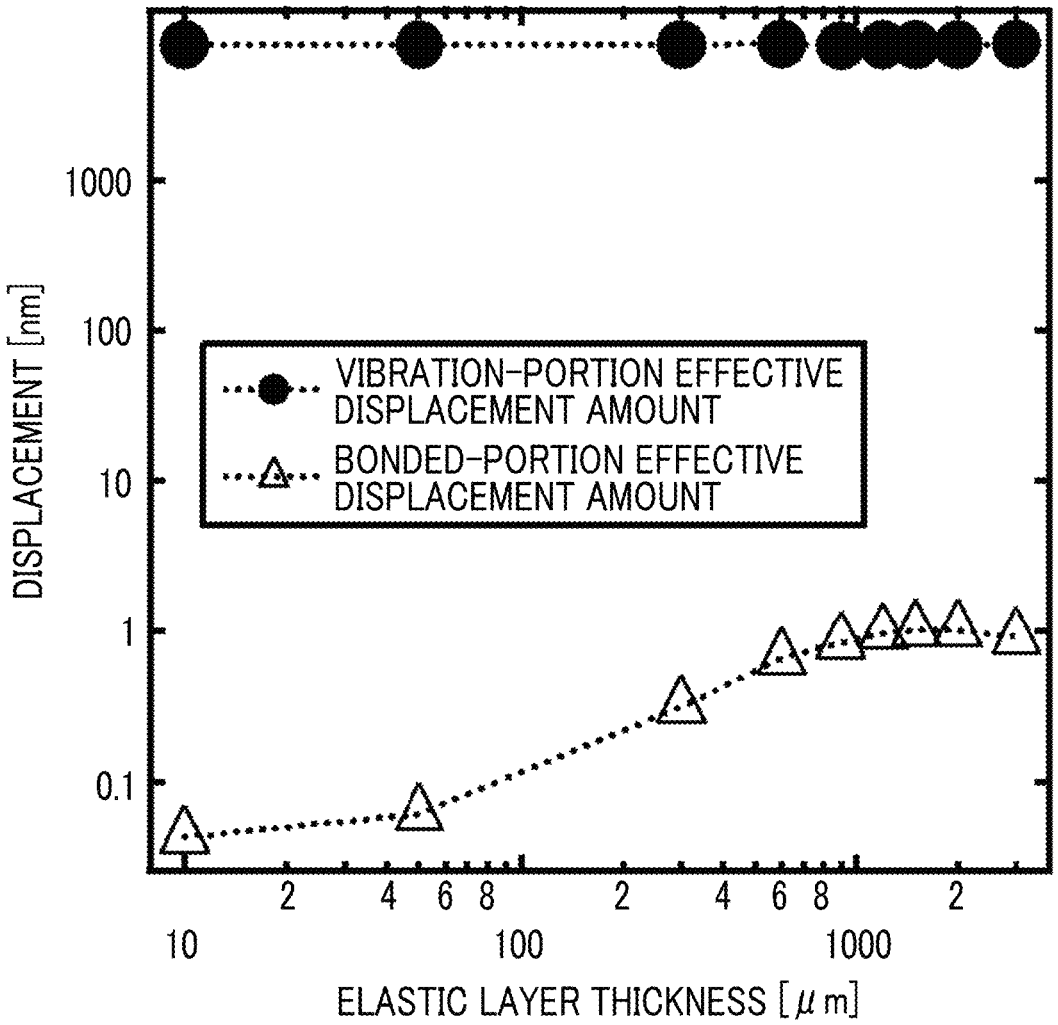
FIG. 19 is a graph showing a relationship between a thickness of the elastic layer and displacement.
Figure 20:
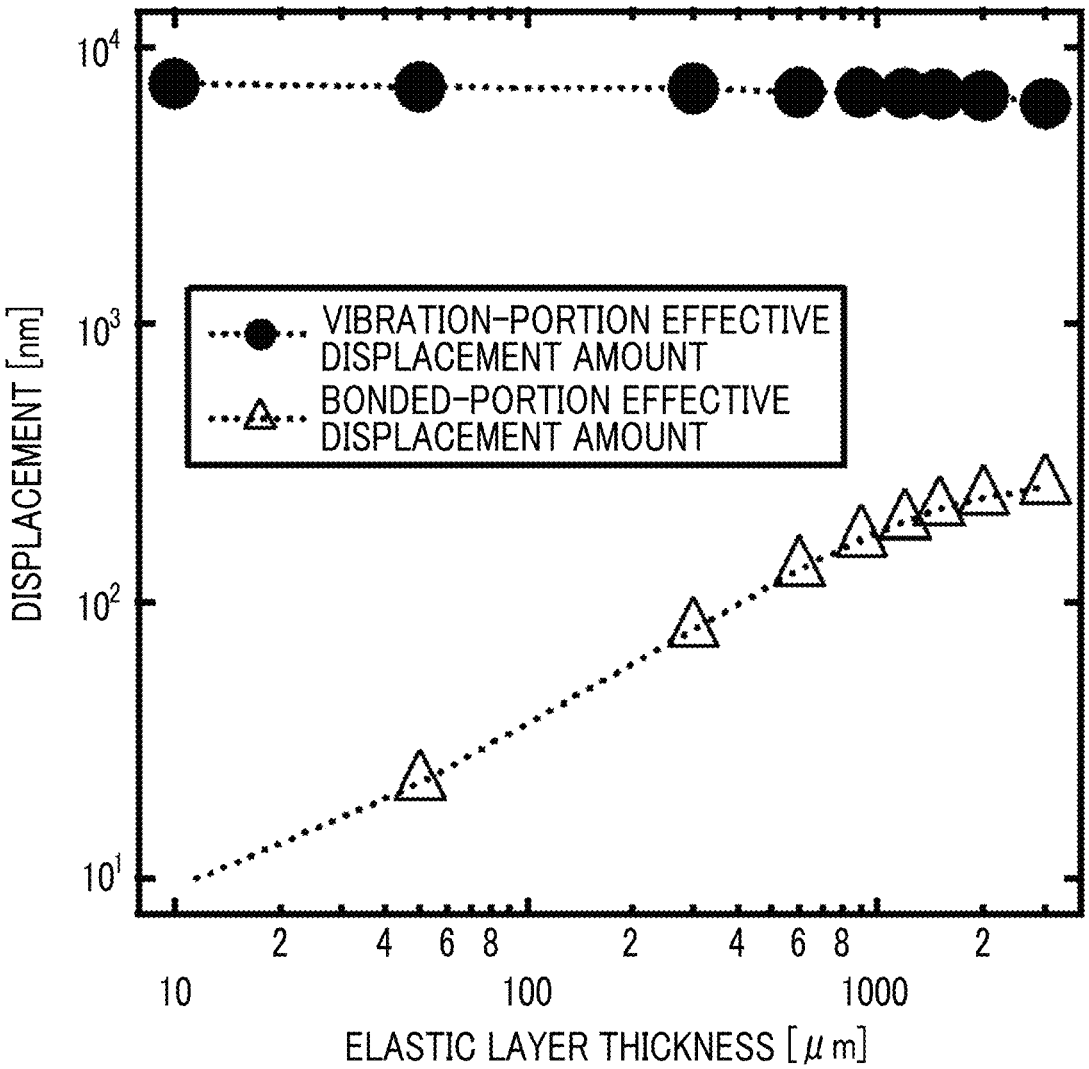
FIG. 20 is a graph showing a relationship between a thickness of the elastic layer and displacement.
Figure 21:
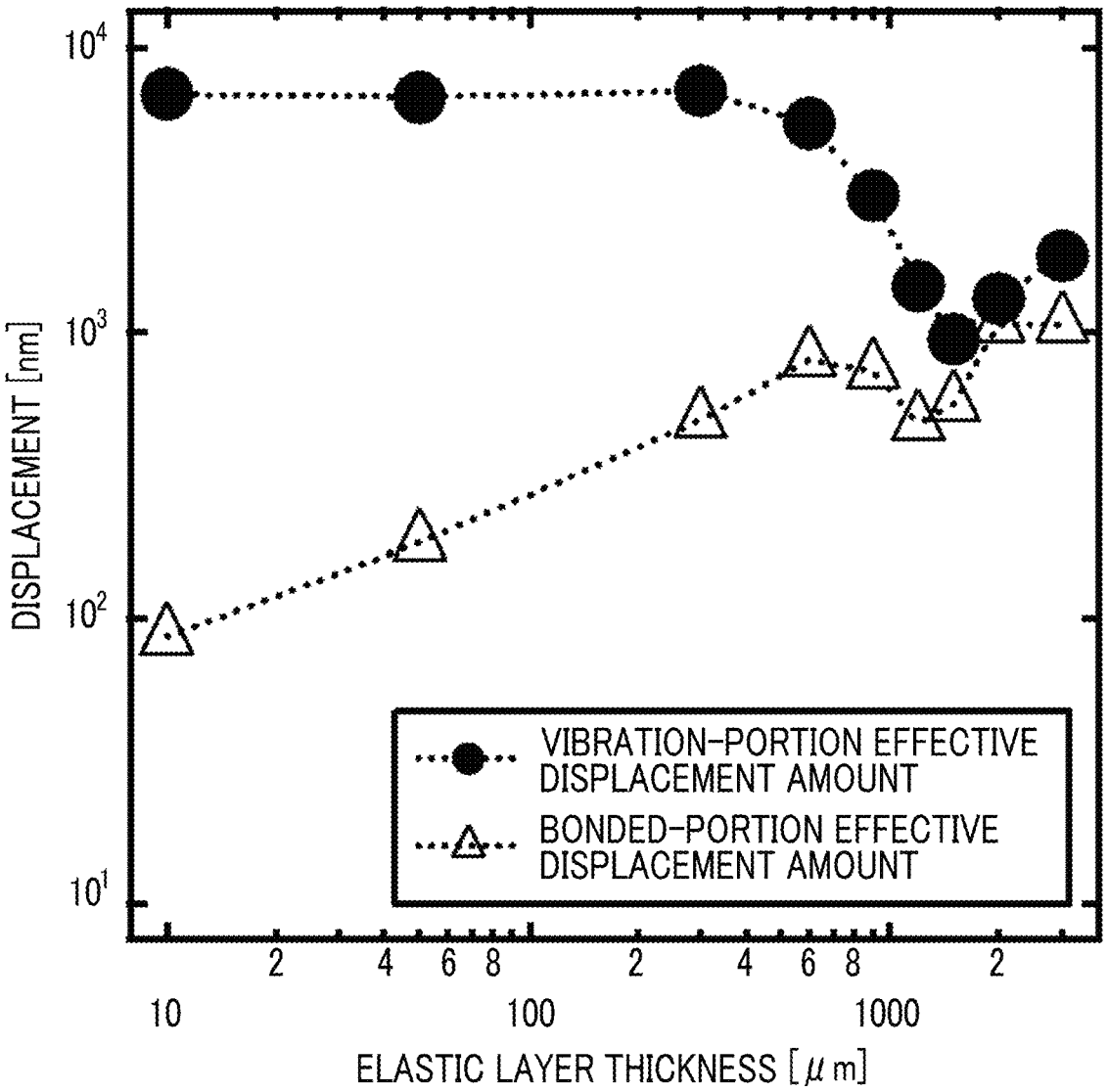
FIG. 21 is a graph showing a relationship between a thickness of the elastic layer and displacement.

FIG. 18 shows the relationship between the thickness of the elastic layer and the absorption peak frequency obtained through the simulations. FIG. 19 shows the relationship between the modulus of elasticity and the vibration-portion effective displacement amount and the bonded-portion effective displacement amount of the film in the absorption peak frequency of Simulation 2, FIG. 20 shows the relationship between the modulus of elasticity and the vibration-portion effective displacement amount and the bonded-portion effective displacement amount of the film in the absorption peak frequency of Simulation 3, and FIG. 21 shows the relationship between the modulus of elasticity and the vibration-portion effective displacement amount and the bonded-portion effective displacement amount of the film in the absorption peak frequency of Simulation 4.

As shown in FIG. 18, it can be seen that as the thickness of the elastic layer becomes thicker, the absorption peak frequency becomes low. However, it can be seen from the results of Simulation 2 that in a case where the thickness of the elastic layer is very thick, the absorption peak frequency is sharply increased.

In a case where the thickness of the elastic layer is increased, since the volume of the closed space is increased, a decrease in frequency is accordingly observed, but the increase in thickness of the elastic layer does not contribute to the decrease in frequency.

[Simulation 5]

A simulation model was created similarly to Example 1 except that the thickness of the film is 250 μm and the density is 1.4 g/cm$^3$, and the frequency characteristics of the absorption rate were obtained while variously changing the modulus of elasticity of the elastic layer.

Figure 22:
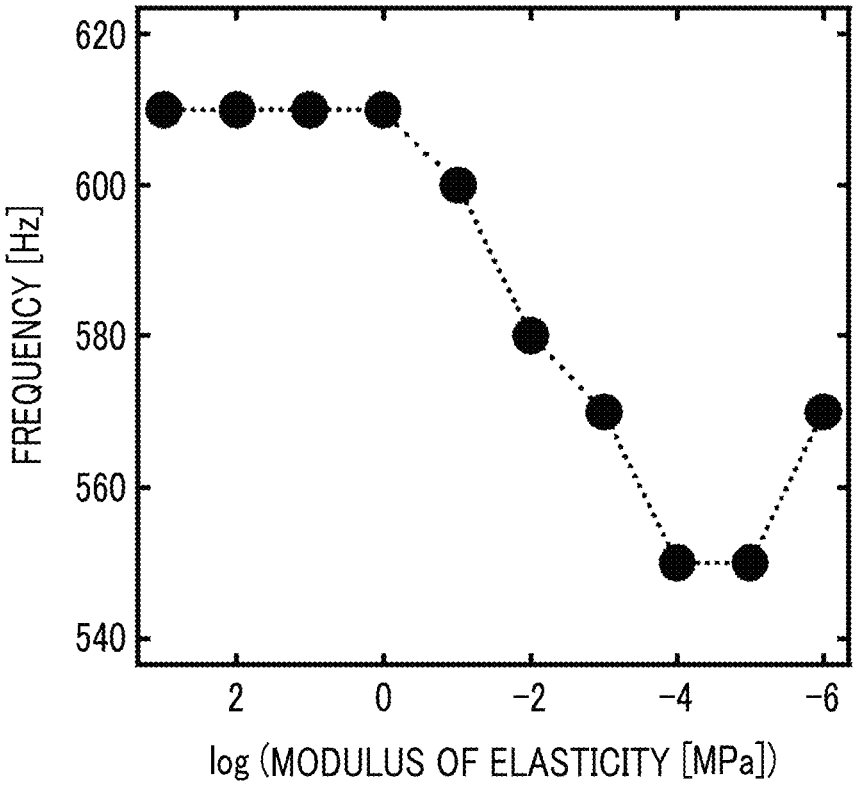
FIG. 22 is a graph showing a relationship between modulus of elasticity and a frequency.
Figure 23:
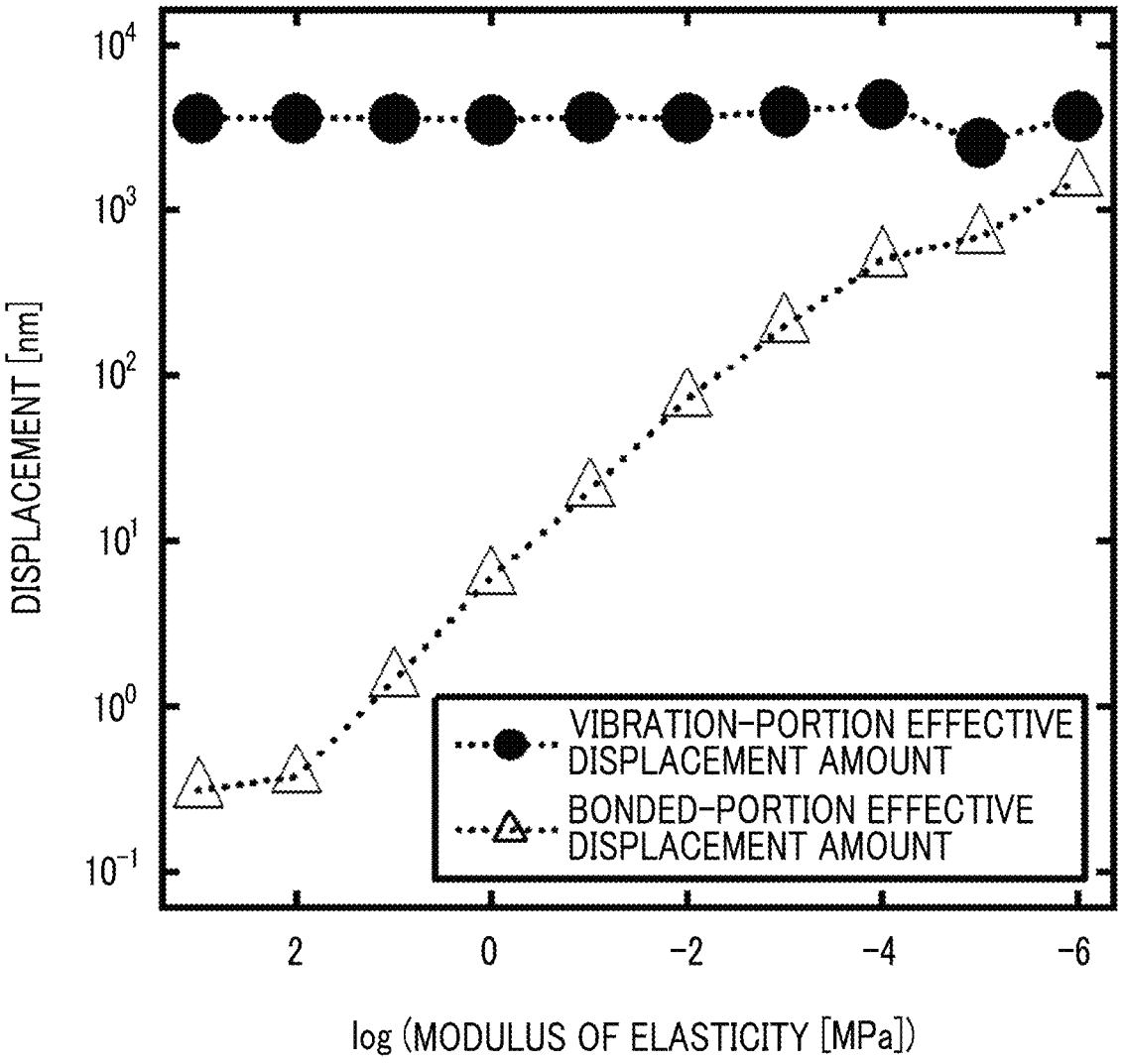
FIG. 23 is a graph showing a relationship between modulus of elasticity and displacement.

FIG. 22 shows the relationship between the modulus of elasticity of the elastic layer and the absorption peak frequency obtained through the simulation. FIG. 23 shows the relationship between the modulus of elasticity and the vibration-portion effective displacement amount and the bonded-portion effective displacement amount of the film in the absorption peak frequency.

The result of Simulation 5 shows that the absorption peak frequency is different from Simulations 1 to 4 but the dependency of the modulus of elasticity is the same.

Figure 24:
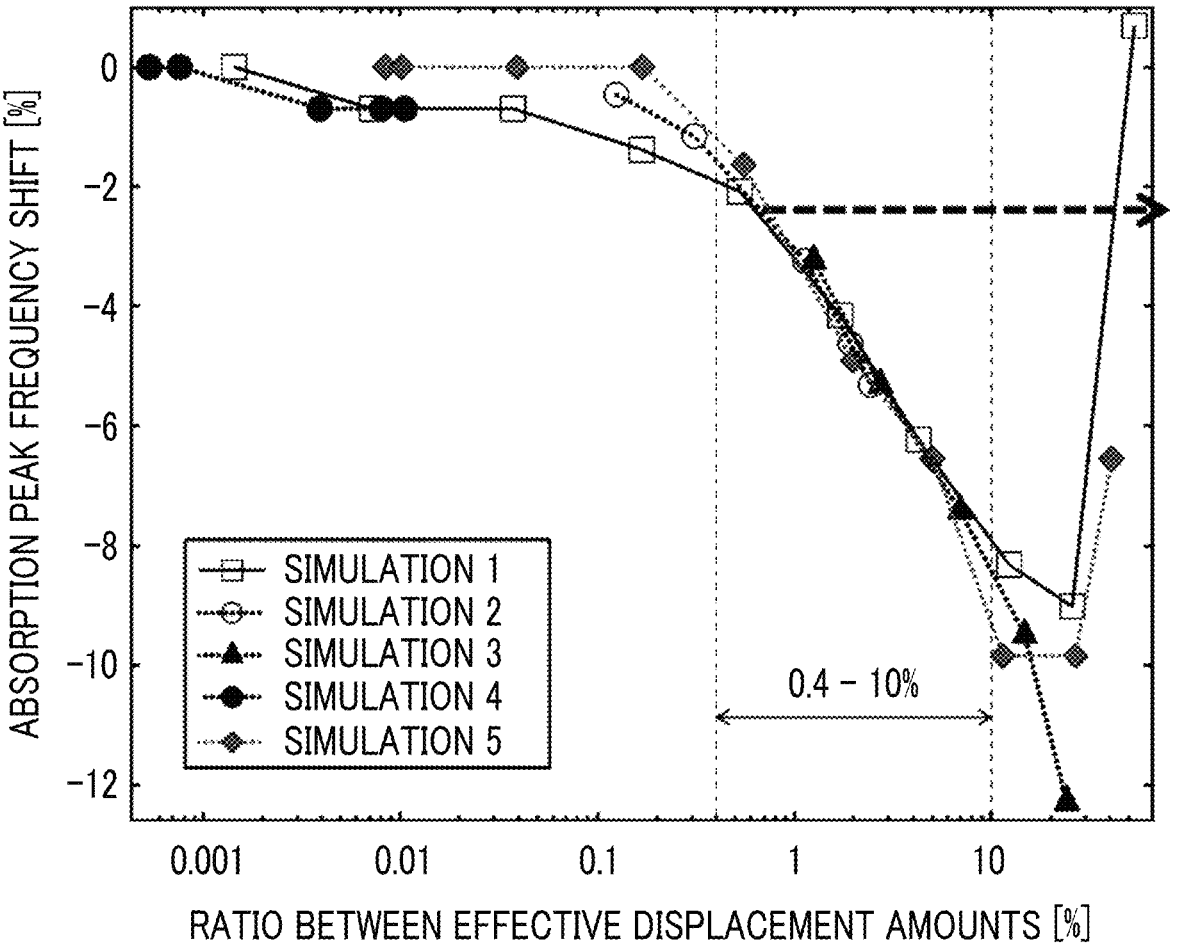
FIG. 24 is a graph showing a relationship between a ratio between effective displacement amounts and a shift amount of an absorption peak frequency.

From the results of Simulations 1 to 5, the relationship between a shift amount of the absorption peak frequency and a ratio between the vibration-portion effective displacement amount and the bonded-portion effective displacement amount (the ratio between the effective displacement amounts) was obtained, and shown in FIG. 24.

Assuming that the absorption peak frequency is F and the absorption peak frequency (equivalent to the rigid body) in a case where the modulus of elasticity of the elastic layer is 1 GPa is $F_0$, the shift amount of the absorption peak frequency was obtained as $100\times(1-F/F_0)$.

As shown in FIG. 24, it can be seen that the results of Simulations 1 to 5 are represented on substantial one curve and are universal characteristics showing the same sound absorption characteristics for the ratio between the effective displacement amounts regardless of the modulus of elasticity and thickness of the elastic layer and the material of the film. Thus, it can be seen that the displacement amount of the film in the portion bonded to the elastic layer is increased, and thus, the decrease in frequency is generated in order to change the vibration mode of the entire film.

In this example, it can be seen from FIG. 24 that the ratio between the effective displacement amounts ranges from 0.4% to 10% and the shift amount of the absorption peak frequency is 2% or more.

Figure 25:
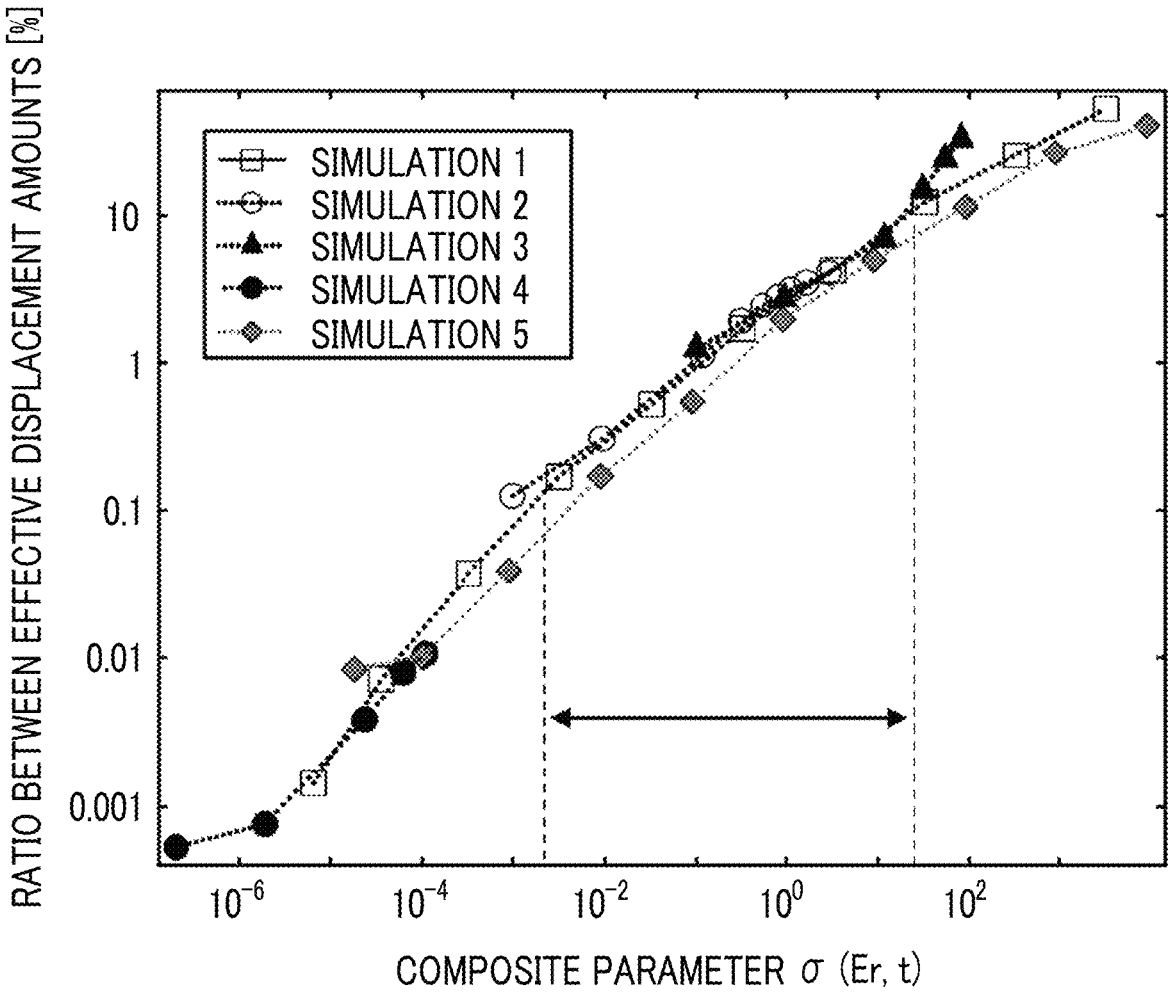
FIG. 25 is a graph showing a relationship between a composite parameter and a ratio between the effective displacement amounts.

The composite parameter $\sigma=t^{1.4}\times(1+1/E_{eff})$ is obtained from the results of Simulations 1 to 5, and the relationship between the composite parameter σ and the ratio between the effective displacement amounts is shown as a graph in FIG. 25.

As shown in FIG. 25, it can be seen that the composite parameter and the ratio between the effective displacement amounts are represented on substantial one curve and are universal characteristics regardless of the modulus of elasticity and the thickness of the elastic layer and the material of the film.

It can be seen from FIG. 25 that the composite parameter σ is preferably $3.0\times10^{-2}<\sigma<5.0\times10^{1}$ from the range of 0.4% to 10% of the ratio between the effective displacement amounts in which the shift amount of the absorption peak frequency is 2% or more. It can be seen that the shift amount of the absorption peak frequency is preferably 4% or more by setting the composite parameter σ to be $3.0\times10^{-1}<\sigma<5.0\times10^{1}$ and the shift amount of the absorption peak frequency is more preferably 6% or more by setting the composite parameter to be $2.5<\sigma<5.0\times10^{1}$.

Figure 26:
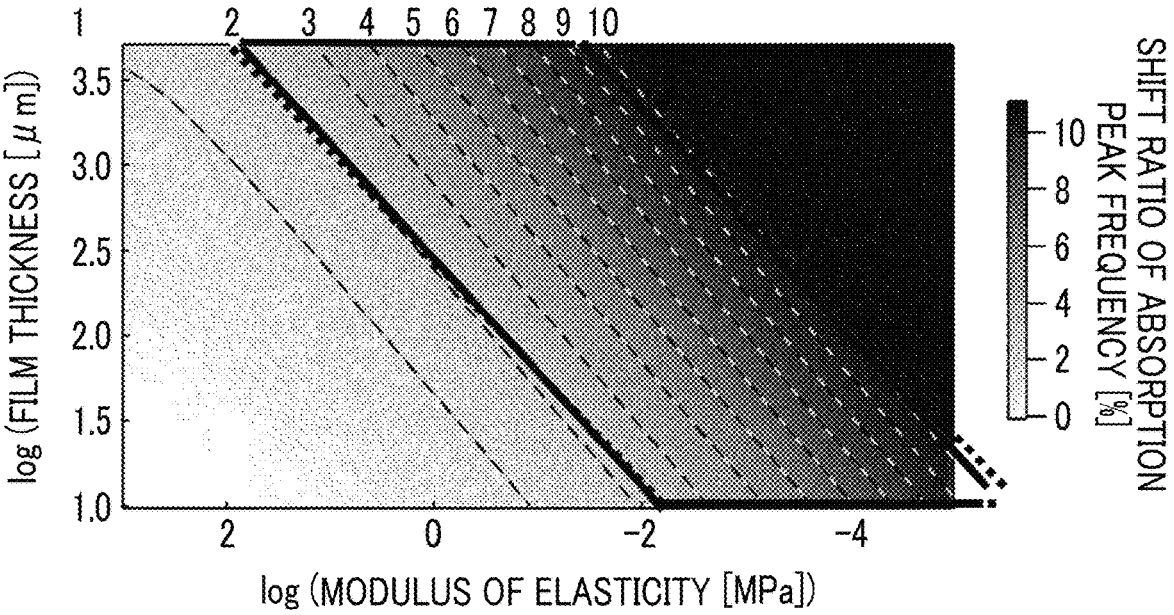
FIG. 26 is a graph showing a relationship between modulus of elasticity, a film thickness, and a shift ratio of an absorption peak frequency.

The relationship between the modulus of elasticity and thickness of the elastic layer and the shift amount of the absorption peak frequency is shown as a graph in FIG. 26. In the graph of FIG. 26, a range satisfying the composite parameter is represented by a thick line.

Example 1

Next, the soundproof structure according to the embodiment of the present invention was created similarly to Comparative Example 1 except that a double-sided tape 2 ("double-sided tape transparent type backing-less" (use of acrylic-based adhesive, adhesive force of 5.4 N/10 mm, thickness of 50 μm) manufactured by Nitto Denko Corporation) was used as the elastic layer instead of the double-sided tape 1, and the frequency characteristics of the absorption rate were measured.

The vibration-portion effective displacement amount of the film was 4428 nm, the bonded-portion effective displacement amount was 63.7 nm, and the ratio between the effective displacement amounts was 1.44%. The effective modulus of elasticity $E_{eff}$ was $1\times10^{-5}$ GPa. The composite parameter σ was $9.52\times10^{-2}$.

Figure 27:
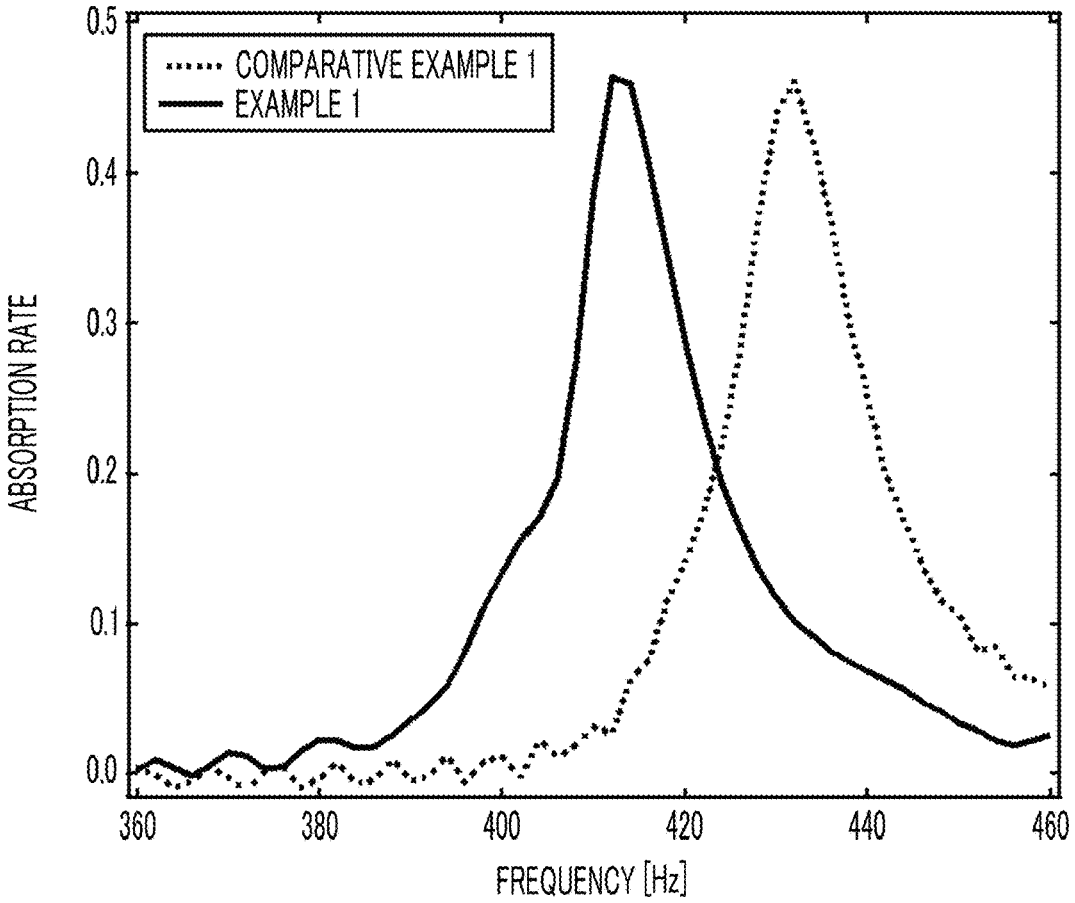
FIG. 27 is a graph showing a relationship between a frequency and an absorption rate.

FIG. 27 shows the relationship between the frequency and the absorption rate of Example 1 and Comparative Example 1.

Figure 28:
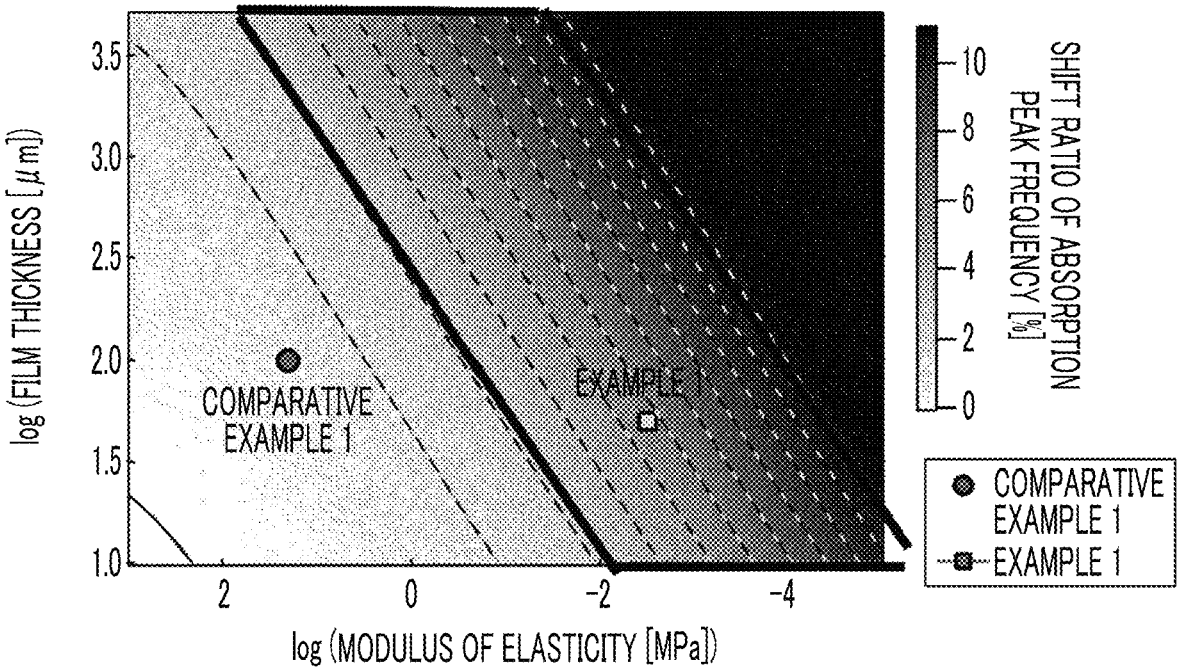
FIG. 28 is a graph showing a relationship between modulus of elasticity, a film thickness, and a shift ratio of an absorption peak frequency.

It can be seen from FIG. 27 that the absorption peak frequency is 432 Hz in Comparative Example 1, but the absorption peak frequency is 413 Hz which is decreased by 4.4% in Example 1. A graph of FIG. 28 is obtained by plotting these two values in the graph of the modulus of elasticity and the thickness of FIG. 26.

Example 2

The soundproof structure according to the embodiment of the present invention was manufactured similarly to Comparative Example 1 except that three double-sided tapes 1 were used as the elastic layer, and the frequency characteristics of the absorption rate were measured.

The vibration-portion effective displacement amount of the film was 4442 nm, the bonded-portion effective displacement amount was 74 nm, and the ratio between the effective displacement amounts was 1.67%. The effective modulus of elasticity $E_{eff}$ was $8.2\times10^{-5}$ GPa. The composite parameter σ was 0.143.

Example 3

The soundproof structure according to the embodiment of the present invention was manufactured similarly to Comparative Example 1 except that six double-sided tapes 1 are used as the elastic layer, and the frequency characteristics of the absorption rate were measured.

The vibration-portion effective displacement amount of the film was 5694 nm, the bonded-portion effective displacement amount was 501 nm, and the ratio between the effective displacement amounts was 8.8%. The effective modulus of elasticity $E_{eff}$ was $2.6\times10^{-6}$ GPa. The composite parameter σ was 12.1.

Figure 29:
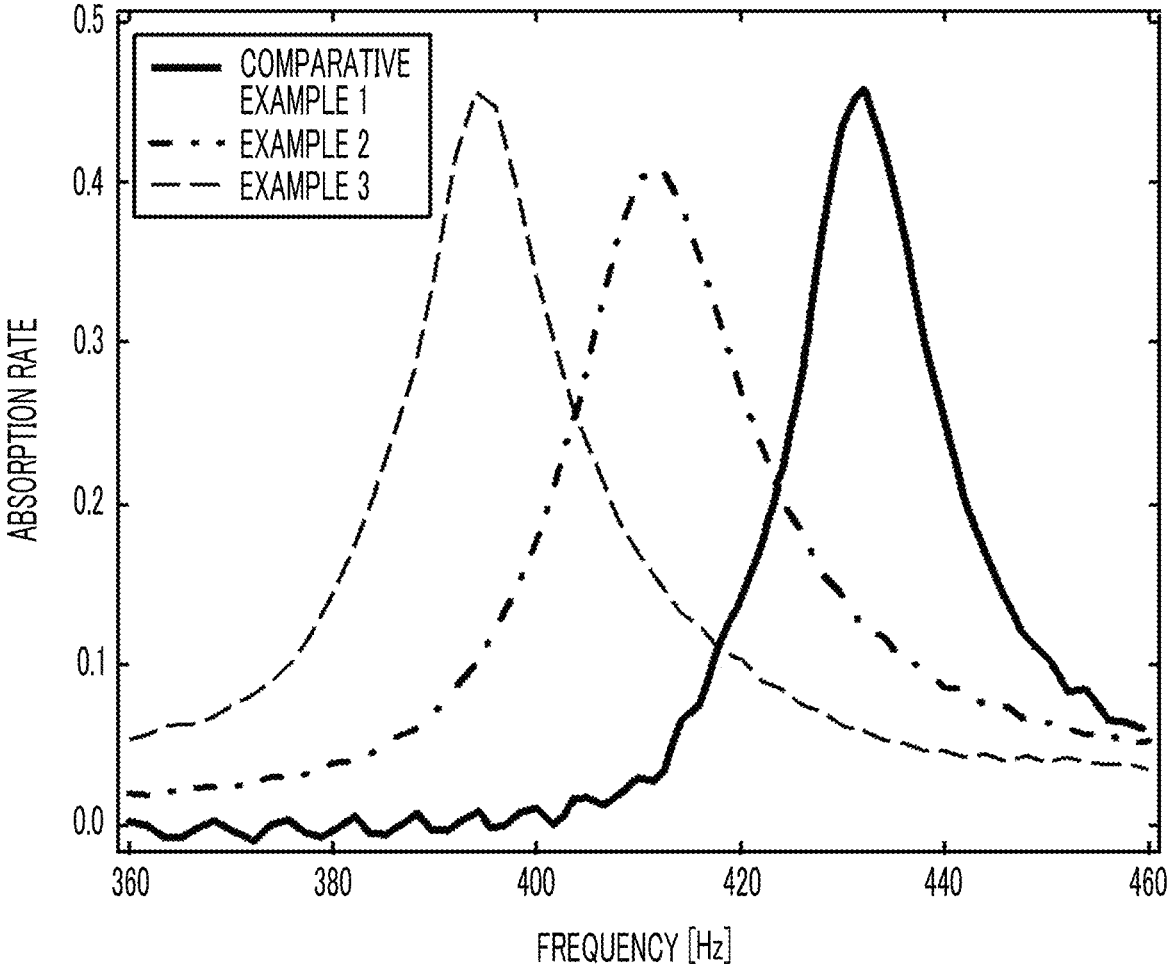
FIG. 29 is a graph showing a relationship between a frequency and an absorption rate.

FIG. 29 shows the relationship between the frequency and the absorption rate of Examples 2 and 3 and Comparative Example 1.

It can be seen from FIG. 29 that the absorption peak frequency was 432 Hz in Comparative Example 1, whereas the absorption peak frequency was 412 Hz which is decreased by 4.63% in Example 2. It can be seen that the absorption peak frequency is 394 Hz in Example 3, and is decreased by 8.80%.

Figure 30:
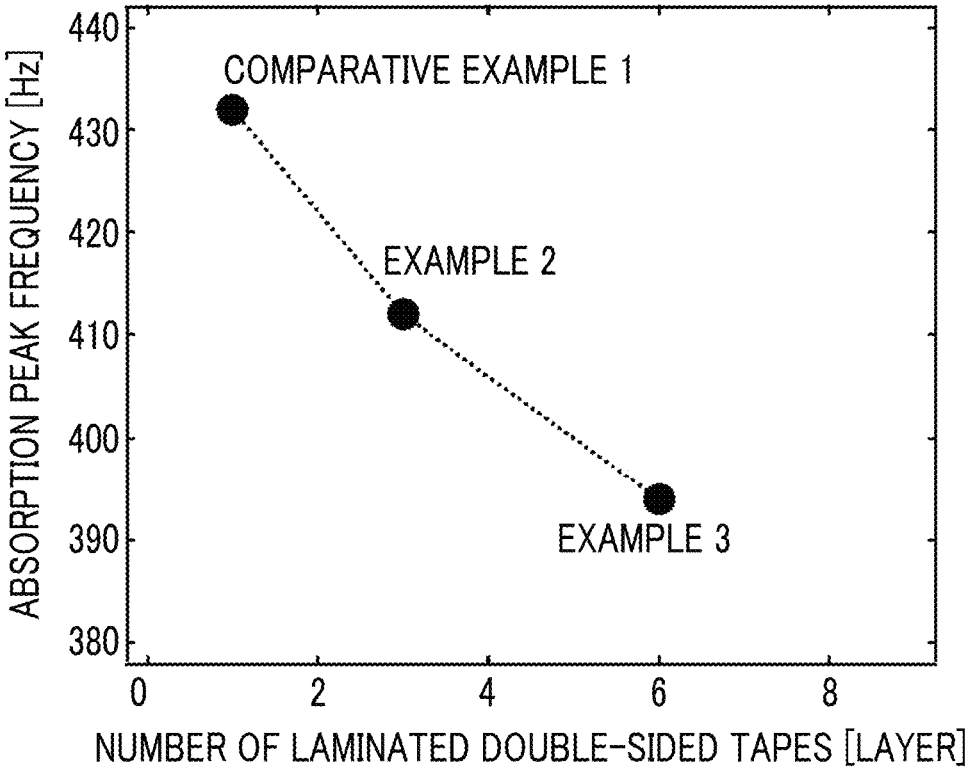
FIG. 30 is a graph showing a relationship between the number of laminated double-sided tapes and an absorption peak frequency.

The relationship between the number of laminated double-sided tapes and the absorption peak frequency from the results of Examples 2 and 3 and Comparative Example 1 is shown as a graph in FIG. 30.

Figure 31:
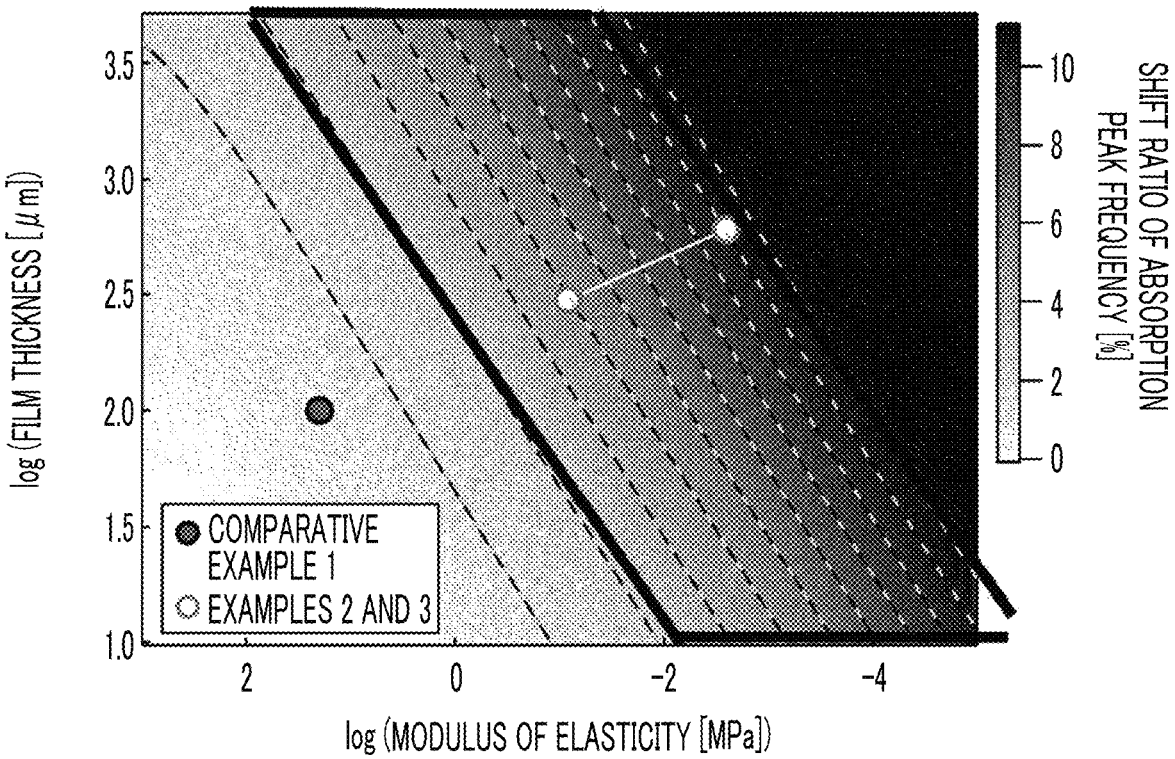
FIG. 31 is a graph showing a relationship between modulus of elasticity, a film thickness, and a shift ratio of an absorption peak frequency.

A graph of FIG. 31 is obtained by plotting these three values in the graph of the modulus of elasticity and the thickness of FIG. 26.

While the soundproof structure according to the embodiment of the present invention has been described in detail with reference to various embodiments and examples, the present invention is not limited to these embodiments and examples, and various improvements or modifications may be made without departing from the scope and spirit of the present invention.

EXPLANATION OF REFERENCES

10*a*, 10*b*, 10*c*, 100: soundproof structure
12: hole portion
14: frame
16: film
18: elastic layer
20*a*: first layer
20*b*: second layer
20*c*: third layer
22: soundproof cell
30: acoustic tube
32: microphone
34: speaker
36: box

What is claimed is:

1. A soundproof structure comprising:

at least one soundproof cell including a frame having a hole portion, an elastic layer laminated on a frame of an opening surface of the frame, and a film laminated on the elastic layer so as to cover the hole portion, wherein an effective displacement amount at a position at which an amplitude is maximized in a region bonded to the elastic layer in a case where a film vibration of the film occurs is 0.4% to 10% of an effective displacement amount at a position at which an amplitude of the film is maximized.

2. The soundproof structure according to claim 1, wherein the elastic layer is an adhesive layer which bonds the frame and the film.

3. The soundproof structure according to claim 1, wherein, in a case where a thickness of the elastic layer is t and an effective modulus of elasticity of the elastic layer in a thickness direction is $E_{eff}$, a composite parameter $\sigma=t^{1.4}\times(1+1/E_{eff})$ satisfies $3.0\times10^{-2}<\sigma<5\times10^{1}$.

4. The soundproof structure according to claim 2, wherein, in a case where a thickness of the elastic layer is t and an effective modulus of elasticity of the elastic layer in a thickness direction is $E_{eff}$, a composite parameter $\sigma=t^{1.4}\times(1+1/E_{eff})$ satisfies $3.0\times10^{-2}<\sigma<5\times10^{1}$.

5. The soundproof structure according to claim 3, wherein the elastic layer is a single layer, and the effective modulus of elasticity $E_{eff}$ of the elastic layer in the thickness direction is Young's modulus $E_{young}$ (GPa) of a material of the elastic layer.

6. The soundproof structure according to claim 4, wherein the elastic layer is a single layer, and the effective modulus of elasticity $E_{eff}$ of the elastic layer in the thickness direction is Young's modulus $E_{young}$ (GPa) of a material of the elastic layer.

7. The soundproof structure according to claim 3, wherein the elastic layer includes a plurality of layers, and in a case where an indentation modulus of elasticity of the elastic layer is $E_{ind}$, the number of layers is N, and an average thickness of the layers is t, the effective modulus of elasticity $E_{eff}$ of the elastic layer in the thickness direction is $E_{eff}=E_{ind}/\{(t/100)^3\times N^5\}$.

8. The soundproof structure according to claim 4, wherein the elastic layer includes a plurality of layers, and in a case where an indentation modulus of elasticity of the elastic layer is $E_{ind}$, the number of layers is N, and an average thickness of the layers is t, the effective modulus of elasticity $E_{eff}$ of the elastic layer in the thickness direction is $E_{eff}=E_{ind}/\{(t/100)^3\times N^5\}$.

9. The soundproof structure according to claim 1, wherein the soundproof cell is smaller than a wavelength of a first natural vibration frequency of the film vibration of the film.

10. The soundproof structure according to claim 6, wherein the soundproof cell is smaller than a wavelength of a first natural vibration frequency of the film vibration of the film.

11. The soundproof structure according to claim 8, wherein the soundproof cell is smaller than a wavelength of a first natural vibration frequency of the film vibration of the film.

12. The soundproof structure according to claim 9, wherein the first natural vibration frequency is 100000 Hz or less.

13. The soundproof structure according to claim 10, wherein the first natural vibration frequency is 100000 Hz or less.

14. The soundproof structure according to claim 11, wherein the first natural vibration frequency is 100000 Hz or less.

* * * * *